US009062400B2

(12) United States Patent
Okuyama

(10) Patent No.: US 9,062,400 B2
(45) Date of Patent: Jun. 23, 2015

(54) EMBROIDERY DATA PROCESSOR, SEWING MACHINE AND NON-TRANSITORY COMPUTER-READABLE MEDIUM

(71) Applicant: BROTHER KOGYO KABUSHIKI KAISHA, Nagoya, Aichi (JP)

(72) Inventor: Tsuneo Okuyama, Inabe-gun (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/313,237

(22) Filed: Jun. 24, 2014

(65) Prior Publication Data

US 2015/0005922 A1 Jan. 1, 2015

(30) Foreign Application Priority Data

Jun. 26, 2013 (JP) ..... 2013-133444

(51) Int. Cl.
*D05B 19/00* (2006.01)
*D05B 19/10* (2006.01)
*D05B 19/12* (2006.01)

(52) U.S. Cl.
CPC ..... *D05B 19/10* (2013.01); *D05B 19/12* (2013.01)

(58) Field of Classification Search
CPC ..... D05B 19/02; D05B 19/04; D05B 19/10; D05B 19/12; D05B 19/16; D05C 5/00; D05C 5/02
USPC ..... 700/136–138; 112/102.5, 103, 470.01, 112/470.06, 475.18, 475.19
See application file for complete search history.

(56) References Cited

U.S. PATENT DOCUMENTS 5,474,002 A * 12/1995 Goto et al. ..... 112/102.5
6,167,822 B1 * 1/2001 Miyasako et al. ..... 112/102.5
8,061,286 B2 * 11/2011 Hirata et al. ..... 112/470.01

FOREIGN PATENT DOCUMENTS

JP A-3-193090 8/1991
JP A-2002-52280 2/2002

* cited by examiner

*Primary Examiner* — Nathan Durham
(74) *Attorney, Agent, or Firm* — Oliff PLC

(57) ABSTRACT

An embroidery data processor includes a processor and a memory configured to store embroidery data and computer-readable instructions causing the processor to perform processes including calculating a sewing time in which first and second moving mechanisms are driven to move an embroidery pattern or a value contributing to the sewing time, based on the embroidery data, determining an angle relative to the first or second direction, at which angle the embroidery pattern is sewn, based on the calculated sewing time or the contributing value, storing the determined angle having correspondence relation with the embroidery pattern at a plurality of different angles, comparing each calculated amount of sewing time with the other, and determining a relative angle at which an amount of sewing time becomes shortest, based on comparison result.

8 Claims, 14 Drawing Sheets

200

| i | DATA FORMAT |
|---|---|
| 1 | SEWING DATA $P_1$(X1, Y1) |
| . | . |
| . | . |
| . | . |
| . | . |
| 250 | $P_{250}$(X250, Y250) |
| 251 | SEWING END DATA |

500

| i | DATA FORMAT |
|---|---|
| 1 | SEWING DATA $Q_1$(X1', Y1') |
| . | . |
| . | . |
| . | . |
| . | . |
| 250 | $Q_{250}$(X250', Y250') |
| 251 | SEWING END DATA |

600

| i | DATA FORMAT |
|---|---|
| 1 | FRAME ROTATION INSTRUCTION DATA $R_1(\alpha 1)$ |
| 2 | SEWING DATA $T_1$(X1'', Y1'') |
| . | . |
| . | . |
| . | . |
| . | . |
| 101 | $T_{100}$(X100'', Y100'') |
| 102 | FRAME ROTATION INSTRUCTION DATA $R_2(\alpha 2)$ |
| 103 | SEWING DATA $T_{101}$(X101'', Y101'') |
| . | . |
| . | . |
| . | . |
| . | . |
| 202 | $T_{200}$(X200'', Y200'') |
| 203 | FRAME ROTATION INSTRUCTION DATA $R_3(\alpha 3)$ |
| 204 | SEWING DATA $T_{201}$(X201'', Y201'') |
| . | . |
| . | . |
| . | . |
| . | . |
| 253 | $T_{250}$(X250'', Y250'') |
| 254 | SEWING END DATA |

FIG. 6

EMBROIDERY DATA PROCESSOR, SEWING MACHINE AND NON-TRANSITORY COMPUTER-READABLE MEDIUM

CROSS-REFERENCE TO RELATED APPLICATIONS

This application is based upon and claims the benefit of priority from the prior Japanese Patent Application No. 2013-133444 filed on Jun. 26, 2013, the entire contents of which are incorporated herein by reference.

BACKGROUND

1. Technical Field

The present disclosure relates to an embroidery data processor, a sewing machine and a non-transitory computer-readable medium.

2. Related Art

Sewing machines provided with embroidery frames have been conventionally known. For example, a conventional sewing machine includes a drive unit moving an embroidery frame holding a workpiece cloth, in the x direction and the y direction, a drive unit rotating the embroidery frame, an x-axis drive unit including an x-axis drive motor moving a circular embroidery frame in the x direction and a y-axis drive unit including a y-axis drive motor moving the embroidery frame in the y direction. The embroidery frame, the x-axis drive unit and the y-axis drive unit are mounted on an annular plate. The annular plate is rotatably supported by a base mounted on the sewing machine and rotated by a θ-axis drive unit including a θ-axis drive motor. The embroidery frame is moved in the x direction and the y direction and rotated by the respective drive motors. As a result, an embroidery pattern is sewn on the workpiece cloth at a desirable angle.

SUMMARY

There is a case where a sewing time changes when an angle at which sewing is carried out is changed relative to a moving direction of the embroidery frame, depending upon an embroidery pattern. As an example, assume a case where the letter of "I" is selected as an embroidery pattern from the English alphabet and the selected letter is sewn by satin stitches. The pattern "I" has a lateral dimension Lx and a longitudinal dimension Ly. More specifically, "Lx" designates a width in the satin stitches and "Ly" designates a length in the satin stitches. When the pattern "I" is sewn without tilt relative to the x direction, the embroidery frame needs to be moved by x-axis movement amount "Lx" for every stitch. When the pattern "I" is sewn at a tilt angle of 45° to the x direction, x-axis and y-axis movement amounts of the embroidery frame for every stitch are obtained as about $Lx/\sqrt{2}$ (=about 0.7Lx). Thus, an x-axis movement amount of the embroidery frame is smaller in the case where the pattern I is tilted 45° to the x direction during the sewing than in the case where the pattern I is not tilted to the x direction during the sewing. Further, since the y-axis movement of the embroidery pattern is concurrent with the x-axis movement of the embroidery pattern, a sewing time is shorter in the case where the pattern I is tilted 45° to the x direction during the sewing than in the case where the pattern I is not tilted to the x direction during the sewing. In the conventional sewing machines, however, no consideration has been paid to sewing an embroidery pattern in a tilted state for prioritization of a sewing time, namely, the relationship between an angle of the embroidery pattern to the movement direction of the embroidery frame.

Therefore, an object of the disclosure is to provide an embroidery data processor which processes embroidery data for changing a sewing angle of the embroidery pattern according to a movement direction of the embroidery frame by a drive mechanism, a swing machine provided with the embroidery data processor and a non-transitory computer-readable medium for storing an embroidery data processing program.

The present disclosure provides an embroidery data processor including a processor and a memory configured to store embroidery data moving an embroidery frame and computer-readable instructions that, when executed by the processor, cause the processor to perform processes including calculating a sewing time in which a first moving mechanism and a second moving mechanism are driven to move the embroidery frame in a first direction and a second direction perpendicular to the first direction thereby to sew the embroidery pattern or a value contributing to the sewing time, based on the embroidery data; determining an angle relative to the first or second direction, at which angle the embroidery pattern is sewn, based on the calculated sewing time or the value contributing to the sewing time; storing, in a memory, the determined relative angle having a correspondence relation with the embroidery data of the embroidery pattern; calculating sewing times required to sew the embroidery pattern at a plurality of different angles; comparing each one of the calculated amounts of sewing time with the other; and determining a relative angle at which an amount of sewing time becomes shortest, based on a result of the comparison.

The disclosure also provides a sewing machine including a sewing unit driving a first moving mechanism moving an embroidery frame in a first direction and a second moving mechanism moving the embroidery frame in a second direction perpendicular to the first direction, the second moving mechanism being drivable simultaneously with the first moving mechanism, a processor and a memory configured to store embroidery data moving an embroidery frame and computer-readable instructions that, when executed by the processor, cause the processor to perform processes including calculating a sewing time in which a first moving mechanism and a second moving mechanism are driven to move the embroidery frame in a first direction and a second direction perpendicular to the first direction thereby to sew the embroidery pattern or a value contributing to the sewing time, based on the embroidery data; determining an angle relative to the first or second direction, at which angle the embroidery pattern is sewn, based on the calculated sewing time or the value contributing to the sewing time; driving the first moving mechanism and the second moving mechanism to sew the embroidery pattern, based on the determined relative angle; determining whether or not the embroidery frame is rotatable; rotating the embroidery frame to the determined relative angle when the processor determines that the embroidery frame is rotatable and driving the first moving mechanism and the second moving mechanism so that the embroidery frame is moved after rotation thereof and is sewn according to the embroidery data.

The disclosure further provides a non-transitory computer-readable medium storing a program for an apparatus including a sewing unit driving a first moving mechanism moving an embroidery frame in a first direction and a second moving mechanism moving the embroidery frame in a second direction perpendicular to the first direction, a processor and a memory configured to store embroidery data, wherein the program causes the processor to execute instructions which, when executed, cause the apparatus to calculate a sewing time in which a first moving mechanism and a second moving mechanism are driven to move the embroidery frame in a first direction and a second direction perpendicular to the first direction thereby to sew the embroidery pattern or a value contributing to the sewing time, based on the embroidery data, to determine an angle relative to the first or second direction, at which angle the embroidery pattern is sewn, based on the calculated sewing time or the value contributing to the sewing time, to store, in the memory, the determined relative angle having a correspondence relation with the embroidery data of the embroidery pattern; and calculate sewing times required to sew the embroidery pattern at a plurality of different angles, compare each one of the calculated amounts of sewing time with the other, and determine a relative angle at which an amount of sewing time becomes shortest, based on a result of the comparison.

BRIEF DESCRIPTION OF THE DRAWINGS

In the accompanying drawings:

FIG. 6 is a data structure chart of EEPROM provided in the sewing machine;

DETAILED DESCRIPTION

One embodiment of the embroidery data processor, sewing machine and non-transitory computer-readable medium will be described with reference to the accompanying drawings.

Figure 1:
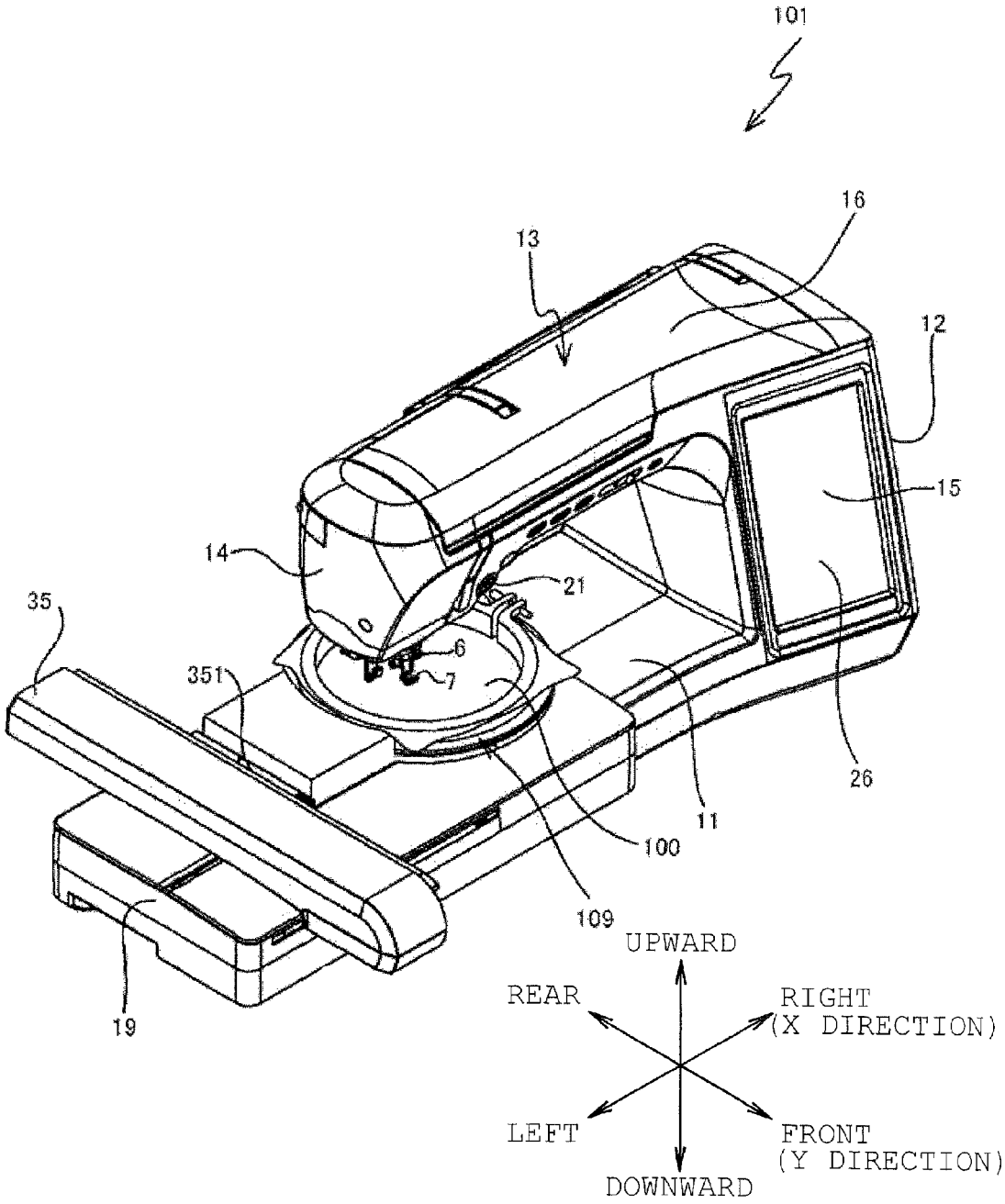
FIG. 1 is a perspective view of a sewing machine in accordance with one embodiment.

Referring first to FIG. 1, a sewing machine 101 is shown which includes a bed 11, a pillar 12, an arm 13 and a head 14. The bed 11 is a base of the sewing machine 101. The bed 11 has a flat surface on which a workpiece cloth 100 is placeable. The pillar 12 extends from the bed 11. The arm 13 extends from the pillar 12 opposite the bed 11.

Relative directions in the embodiment will be defined as follows. The direction in which the pillar 12 extends is referred to as "upward" and the opposite direction is referred to as "downward." The direction in which the arm 13 extends from the pillar 12 is referred to as "leftward" and the opposite direction is referred to as "rightward." The direction perpendicular to the up-down direction and the right-left direction is referred to as "front-back direction."

An embroidery frame 109 to hold the workpiece cloth 100 is attached to an embroidery frame moving device 19 when an embroidery pattern is sewn by the sewing machine 101. The embroidery frame 109 is disposed on upper surfaces of the bed 11 and the moving device 19 body. The moving device 19 moving the embroidery frame 109 is detachably attachable to the bed 11. The moving device 19 is located on the left side of the bed 11 when attached. The moving device 19 is similar to that disclosed in Japanese patent application publication, JP-A-2002-52280 and includes an x-axis moving mechanism and a y-axis moving mechanism moving the embroidery frame 109 in the x direction and the y direction.

Figure 4:
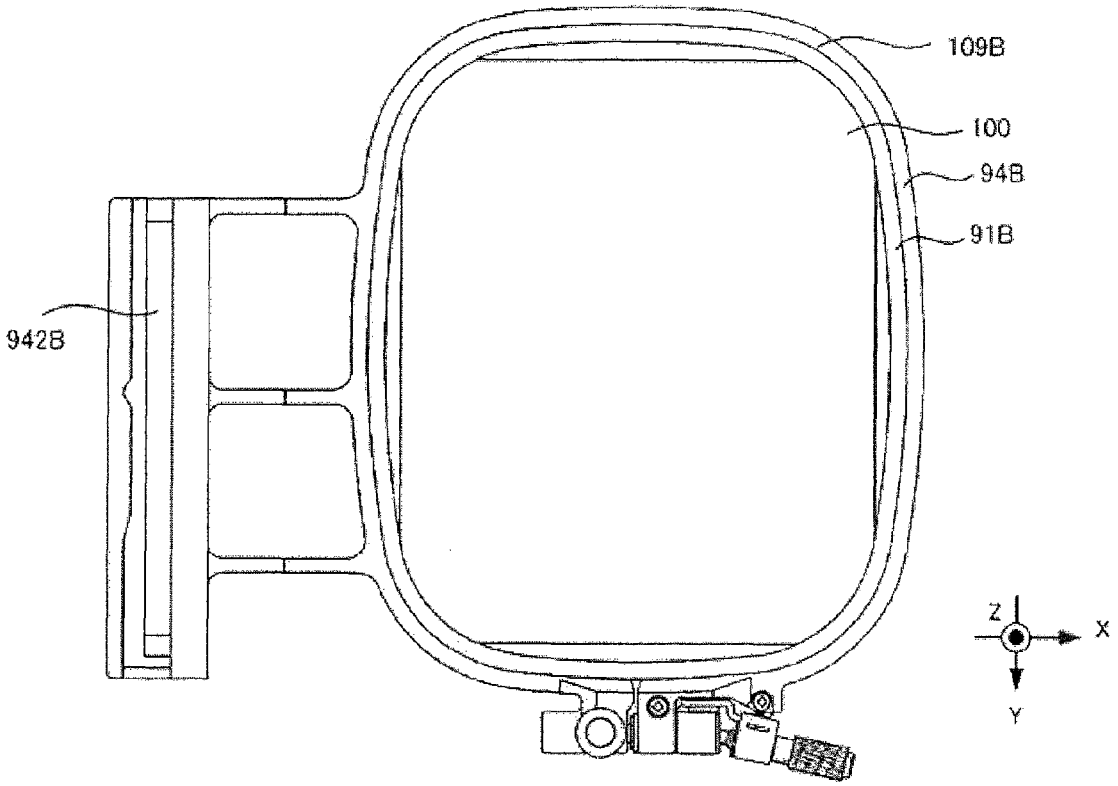
FIG. 4 is a plan view of an embroidery frame of another type provided in the sewing machine.

The sewing machine 101 is provided with a plurality of types of embroidery frames differing in the size or shape, inclusive of the embroidery frame 109. The sewing machine 101 sets a sewable region inside the embroidery frame according to a type of the embroidery frame attached to the embroidery frame moving device 19. FIG. 4 shows an embroidery frame 109B as an example. The embroidery frame 109B includes inner and outer frames 91B and 94B between which the workpiece cloth 100 is held as well known in the art, and detailed description of the embroidery frame 109B will be eliminated. The embroidery frame 109B is detachably attachable to the moving device 19 in the same manner as the embroidery frame 109. In the following description, the embroidery frame 109 will be used for the sake of simplicity.

The moving device 19 includes a carriage cover 35 extending in the front-back direction. The y-axis moving mechanism is provided inside the carriage cover 35. The y-axis moving mechanism moves a carriage in the front-back direction of the sewing machine 101, that is, in the y direction. The embroidery frame 109 is detachably attachable to the carriage. Accordingly, the y-axis moving mechanism moves the embroidery frame 109 in the y direction.

Figure 5:
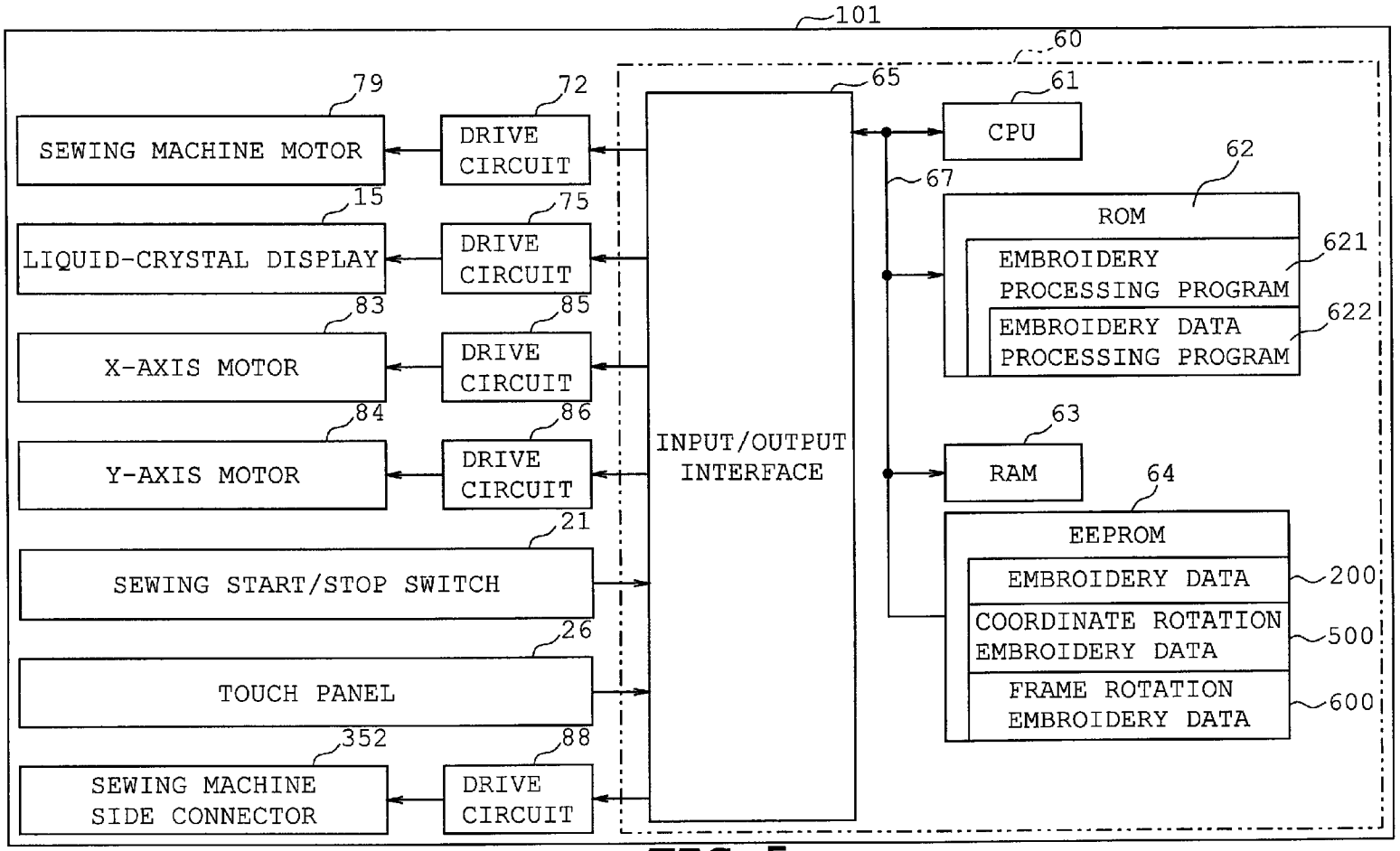
FIG. 5 is a block diagram showing an electrical arrangement of the sewing machine.

An attachment portion 351 to which the embroidery frame 109 is attached is provided on the right side of the carriage. The attachment portion 351 protrudes rightward from a right side of the carriage cover 35. The attachment portion 351 is long in the front-back direction so as to correspond to a mounting portion 942 provided on the embroidery frame 109 shown in FIG. 2. The mounting portion 942 is attached to the attachment portion 351. A sewing machine side connector 352 shown in only FIG. 5 is provided in a rear part of the attachment portion 351. The connector 352 is electrically connectable to a frame side connector 944 provided in the embroidery frame 109. The connector 352 is a female connector and includes a part to be connected to the male connector 944. The connector 352 is disposed with the connected part being directed forward.

The x-axis moving mechanism (not shown) is provided in the body of the moving device 19. The x-axis moving mechanism moves the carriage, the y-axis moving mechanism and the carriage cover 35 in the x direction, namely, in the right-left direction of the sewing machine 101. The embroidery frame 109 is detachably attachable to the carriage. Accordingly, the x-axis moving mechanism moves the embroidery frame 109 in the x direction.

The x-axis and y-axis moving mechanisms can be simultaneously driven by an x-axis motor 83 and a y-axis motor 84 both of which are shown in only FIG. 5, respectively. A needle bar 6 as shown in FIG. 1 and a hook mechanism (not shown) provided in the bed 11 are driven while the embroidery frame 109 is moved in the x and y directions. The sewing machine 101 thus executes a sewing operation of sewing a desired embroidery pattern on the workpiece cloth 100 held by the embroidery frame 109.

A liquid-crystal display 15 is provided on a front of the pillar 12 and formed into a vertically long rectangular shape. The display 15 displays images of various items including a plurality of types of patterns, commands to execute various functions and various types of messages. A touch panel 26 is mounted on a front of the display 15. The touch panel 26 is transparent so that a user can view a screen of the display 15 therethrough. When an item is displayed on the display 15, the user touches a part of the touch panel 26 corresponding to the displayed item with his/her finger or a dedicated touch pen, so that the user can select a pattern to be sewn or a command to be executed.

A sewing start/stop switch 21 is provided on a lower front of the arm 13 to start or stop an operation of the sewing machine 101. When the switch 21 is depressed, the sewing machine 101 instructs start or stop of a sewing operation. A needle bar 6 is mounted on a lower part of the head 14. A needle 7 is attached to a lower end of the needle bar 6.

Figure 2:
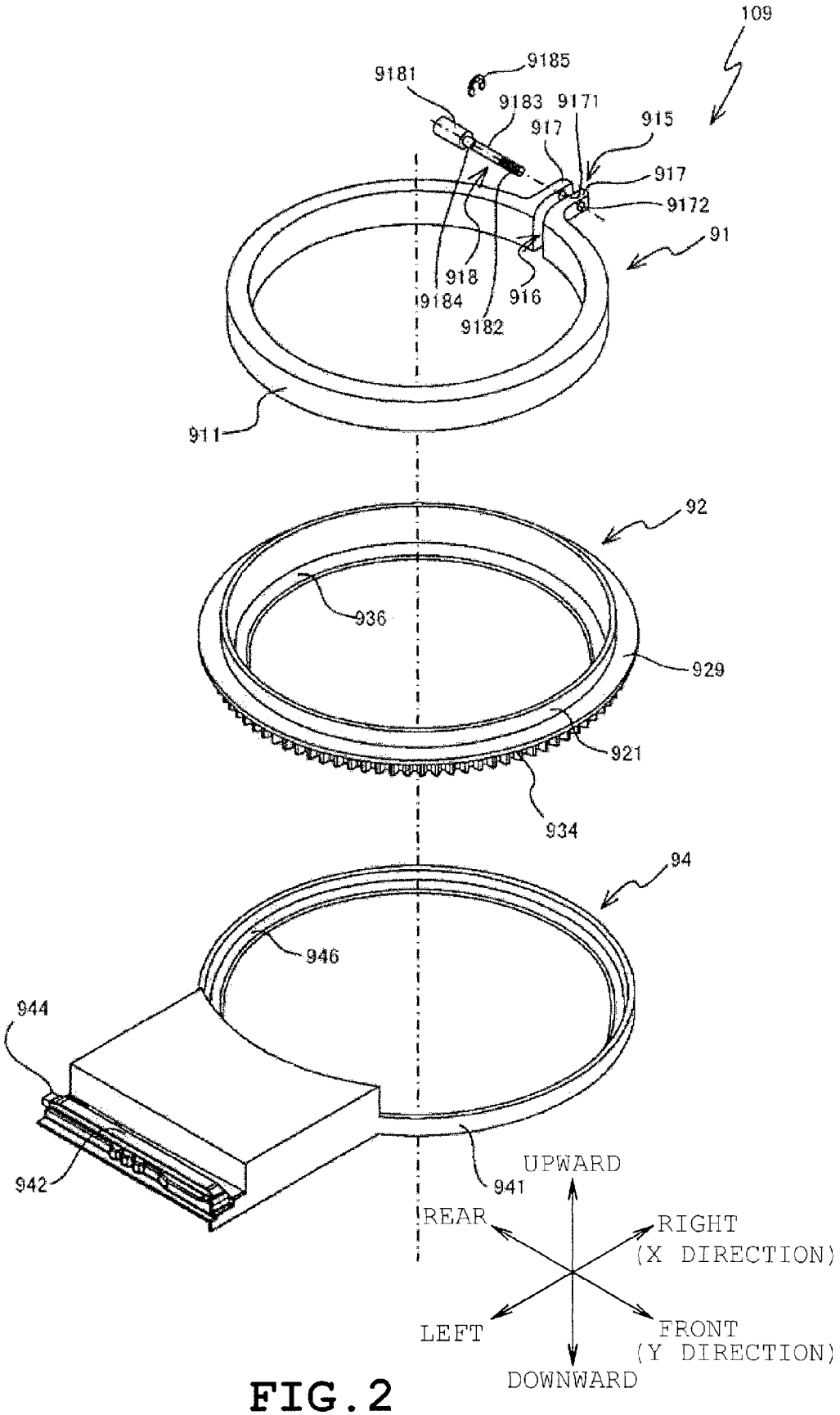
FIG. 2 is an exploded perspective view of an embroidery frame.

Referring now to FIG. 2, the embroidery frame 109 will be described. The embroidery frame 109 includes an inner frame 91, a middle frame 92 and an outer frame 94, all of which are each formed into a circular frame shape. The middle frame 92 is disposed along an outer periphery of the inner frame 91. The outer frame 94 is disposed along an outer periphery of the middle frame 92. The workpiece cloth 100 is held between the inner and middle frames 91 and 92. The middle frame 92 is rotatable relative the outer frame 94.

The inner frame 91 includes a circular frame portion 911 having an axial dimension or width and a radial dimension or thickness. "Axial" refers to a direction in which a central axis of the inner frame 91 extends. The inner frame 91 also includes an adjusting portion which is capable of adjusting a diameter of the frame portion 911. The user adjusts the diameter of the inner frame 91 according to a thickness of the workpiece cloth 100 to be held between the inner and middle frames 91 and 92. The adjusting portion 915 includes a split portion 916, a pair of screw attachment portions 917 and an adjusting screw 918.

The split portion 916 corresponds to a peripheral part of the frame portion 911. The screw attachment portions 917 are formed on upper parts of both sides of the split portion 916 so as to protrude outward and to be opposed to each other. The screw attachment portions 917 are provided with respective holes 9171 and 9172 which are formed so as to extend the screw attachment portions 917 in a direction perpendicular to a plane on which the screw attachment portions 917 are opposed to each other. A nut (not shown) with a screw hole is embedded in one of the holes 9171 and 9172.

The adjusting screw 918 has a head 9181 which has a larger diameter and is held between fingers of the user to be rotated and a shaft 9183 which has a smaller diameter and is formed integrally with the adjusting screw 918 so as to extend from the head 9181. A male screw 9182 is formed on a distal end of the shaft 9183. A narrow groove 9184 is formed in a part of the shaft 9183 located near the head 9181. The adjusting screw 918 is attached to the screw attachment portion 917 so that the shaft 9183 thereof is passed through the hole 9171 and the male screw 9182 threadingly engages the screw hole of the nut embedded in the hole 9172. A stop ring 9185 is fitted into the narrow groove 9184 of the shaft 9183. The adjusting screw 918 is held on the screw attachment portion 917 at the side with the hole 9171 by the stop ring 9185 so that the adjusting screw 918 is rotatable and axially immovable.

The middle frame 92 includes an annular frame portion 921, which has a larger inner diameter than an outer diameter of the frame portion 911 of the inner frame 91. The frame portion 921 of the middle frame 92 is attached to and detached from the frame portion 911 of the inner frame 91, whereby the middle frame 92 is attached to and detached from the inner frame 91. The middle frame 92 has a large gear 934 formed over an entire outer circumference of a lower end of the frame portion 921 of the middle frame 92. The large gear 934 is configured to be brought into mesh engagement with a small gear 948 shown in FIG. 3.

The middle frame 92 has a flange 929 which is formed on an axial middle of the outer circumference of the frame portion 921 thereof so as to be located above the large gear 934. The flange 929 extends over an entire circumference of the frame portion 921 and protrudes radially outward. The middle frame 92 further has a support portion 936 formed on an inner circumference of a lower end of the frame portion 921 thereof. The support portion 936 extends over an entire inner circumference of the frame portion 921 and protrudes radially inward. The support portion 936 is configured to support a lower end surface of the inner frame 91.

The outer frame 94 includes an annular frame portion 941 and a support portion 946 formed on an inner circumference of a lower end of the frame portion 941. The support portion 946 extends over an entire inner circumference of the frame portion 941 and protrudes radially inward. The lower end surface of the middle frame 92 is supported by the support portion 946, whereby the middle frame 92 is held by the frame portion 941.

Figure 3:
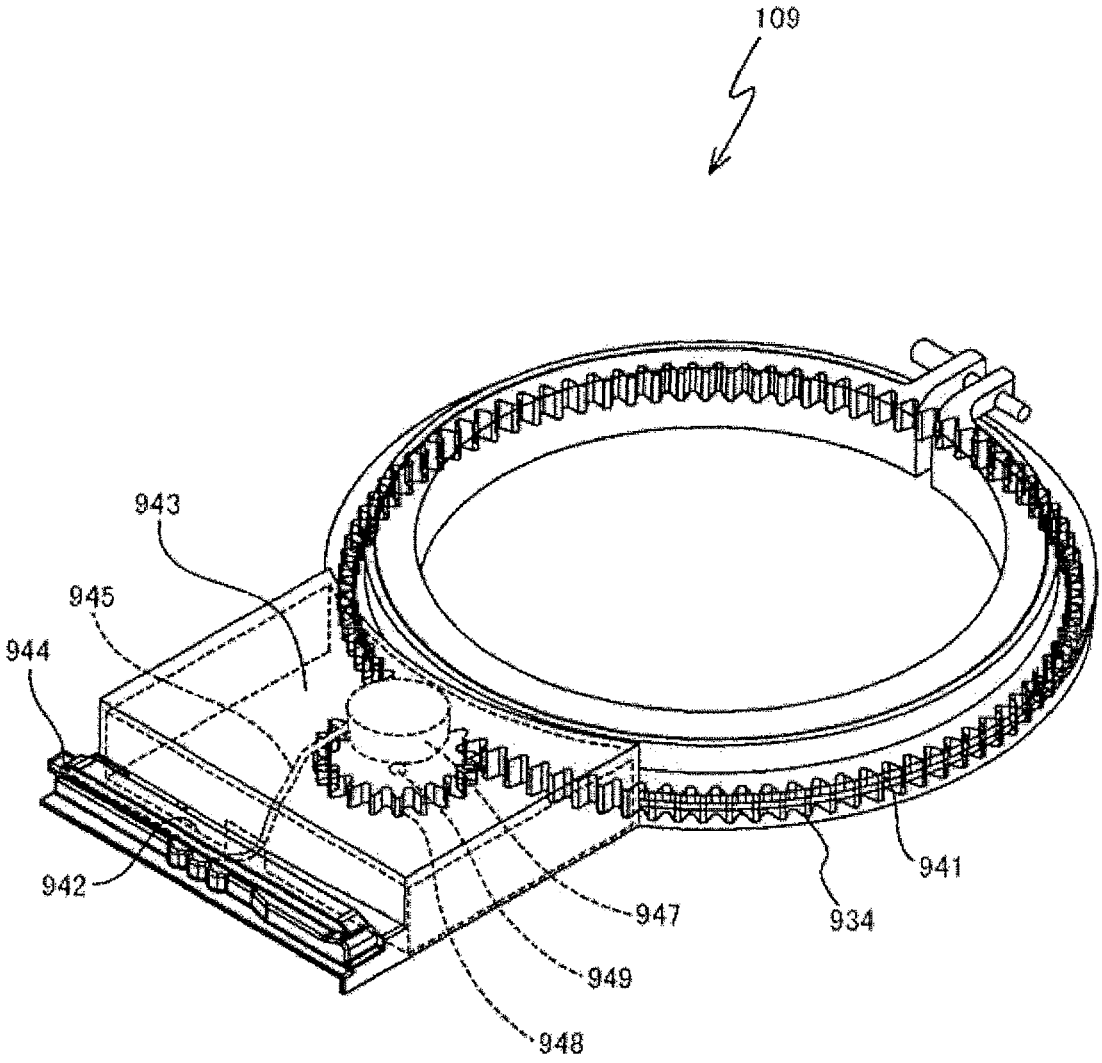
FIG. 3 is a perspective view of the embroidery frame, showing an internal structure thereof.

The mounting portion 942 of the embroidery frame 109 will now be described with reference to FIG. 3. The mounting portion 942 is provided radially outside the frame portion 941. The mounting portion 942 extends substantially in parallel to a tangential direction of the annular frame portion 941. The mounting portion 942 is detachably attachable to the attachment portion 351.

The frame side connector 944 which is a male connector is provided at a tangential end side with respect to the mounting portion 942. The frame side connector 944 has a part which is to be connected to the sewing machine side female connector 352 and is disposed so as to be directed to the tangential end side. When the mounting portion 942 is attached to the attachment portion 351, the frame side connector 944 is simultaneously coupled to the sewing machine side connector 352 thereby to be electrically connected to the connector 352. The frame side connector 944 is electrically connected via a conductive wire 945 to an electric motor 947.

The embroidery frame 109B as shown in FIG. 4 includes a mounting portion 942B having a similar shape to the mounting portion 942 of the embroidery frame 109. However, the embroidery frame 109B has no frame side connector.

A housing 943 is provided between the frame portion 941 and the mounting portion 942. The motor 947 is housed in the housing 943. The housing 943 connects between the mounting portion 842 and the frame portion 941 and is formed into a box shape.

The motor 947 is disposed in the housing 943 with a rotating shaft 949 thereof being directed downward. The small gear 948 is fixed to a lower end of the rotating shaft 949. The small gear 948 has a smaller diameter than the large gear 934 of the middle frame 92. The small gear 948 is in mesh engagement with the large gear 934. When the motor 947 is driven, the small gear 948 and accordingly the large gear 934 are rotated. As a result, the middle frame 92 is rotated relative to the outer frame 94. Upon rotation of the middle frame, the workpiece cloth 100 held between the middle frame 92 and the inner frame 91 is rotated.

An electrical arrangement of the sewing machine 101 will be described with reference to FIG. 5. The sewing machine 101 includes a control 60 provided with a CPU 61, a ROM 62, a RAM 63, an EEPROM 64 and an input/output interface 65, all of which are connected to one another by a bus bar 67. The ROM 62 stores an embroidery processing program 621 on which the CPU 61 executes an embroidering process, and various data. The embroidery processing program 621 includes an embroidery data processing program 622 for processing embroidery data. The EEPROM 64 stores a plurality of embroidery data for the sewing machine 101 to execute embroidery sewing. More specifically, the EEPROM 64 stores at least embroidery data 200, coordinate rotation embroidery data 500 and frame rotation embroidery data 600. The sewing machine 101 functions as a device processing embroidery data in the embodiment.

A sewing start/stop switch 21, a touch panel 26 and drive circuits 72, 75, 85, 86 and 88 are electrically connected to the input/output interface 65. The drive circuit 72 is configured to drive a sewing machine motor 79, and the drive circuit 75 is configured to drive a liquid-crystal display 15. The drive circuits 85 and 86 are configured to drive the x-axis and y-axis motors 83 and 84 both of which move the embroidery frame 109, respectively. The drive circuit 88 is electrically connected to the sewing machine side connector 352. The drive circuit 88 drives via the frame side connector 944 and a conductive wire 945 an electric motor 947 provided on the embroidery frame 109. The CPU 61 controls the motor 947 to rotate the middle frame 92.

The embroidery data 200 will be described with reference to FIG. 6. The embroidery data 200 is provided for embroidering the workpiece cloth 100. The embroidery data 200 includes sewing data $P_j$ and sewing end data. Each of the sewing data $P_j$ and sewing end data has a correspondence relation with a variable i indicative of a processing order of each data of the embroidery data 200. The embroidery data 200 may include frame rotation instruction data $R_k$ which instructs to rotate the embroidery frame 109, color change instruction data which instructs to change a color and sewing stop data which instructs to stop the sewing. The frame rotation instruction data $R_k$ instructs to rotate the embroidery frame 109 to an angle of the middle frame 92 relative to the outer frame 94. The sewing data $P_j$ is provided for moving the embroidery frame 109 for every stitch in the x direction and the y direction relative to a position at which the sewing needle 7 is thrust through the workpiece cloth 100 by the x-axis and y-axis moving mechanisms. The position indicated by the coordinate data will hereinafter be referred to as "needle location point." The sewing end data is indicative of end of embroidery data. The frame rotation instruction data $R_k$ is angle data which instructs to rotate the middle frame 92.

The sewing data $P_j$ of the embroidery data 200 will be described with reference to FIG. 7. The sewing data $P_j$ is represented by x-y coordinates. In the sewing machine 101, a central point of a sewable region set according to a type of the embroidery frame is an origin U (x, y)=(0, 0) of the embroidery coordinate system. When the embroidery frame 109 is attached to the sewing machine 101, the sewing machine 101 sets, as a sewable region, a circular region with a center that is a rotation center of the inner frame 91. In the embodiment, the rotation center of the inner frame 91 is an origin. In the embroidery coordinate system, the right-left direction of the sewing machine 101 corresponds to the x-axis direction, and the front-back direction of the sewing machine 101 corresponds to the y-axis direction. A direction from left to right in the sewing machine 101 is a positive direction of the x axis, and a direction from front to rear is a positive direction of the y axis. Further, the positive x axis is indicative of 0°. When the embroidery frame 109 is viewed from above, the counter-clockwise direction is indicative of positive (+) values relative to the positive x axis, and the clockwise direction is indicative of negative (−) values. Embroidery data 200 includes mask data, which is rectangular data including an entire embroidery pattern 99 and has a minimum size. The embroidery pattern 99 has a center that is central coordinate U of the mask data, for example. In the embodiment, it is assumed that the origin S (x, y) of the embroidery coordinate system corresponds with the central coordinate U of the mask data.

Figure 7:
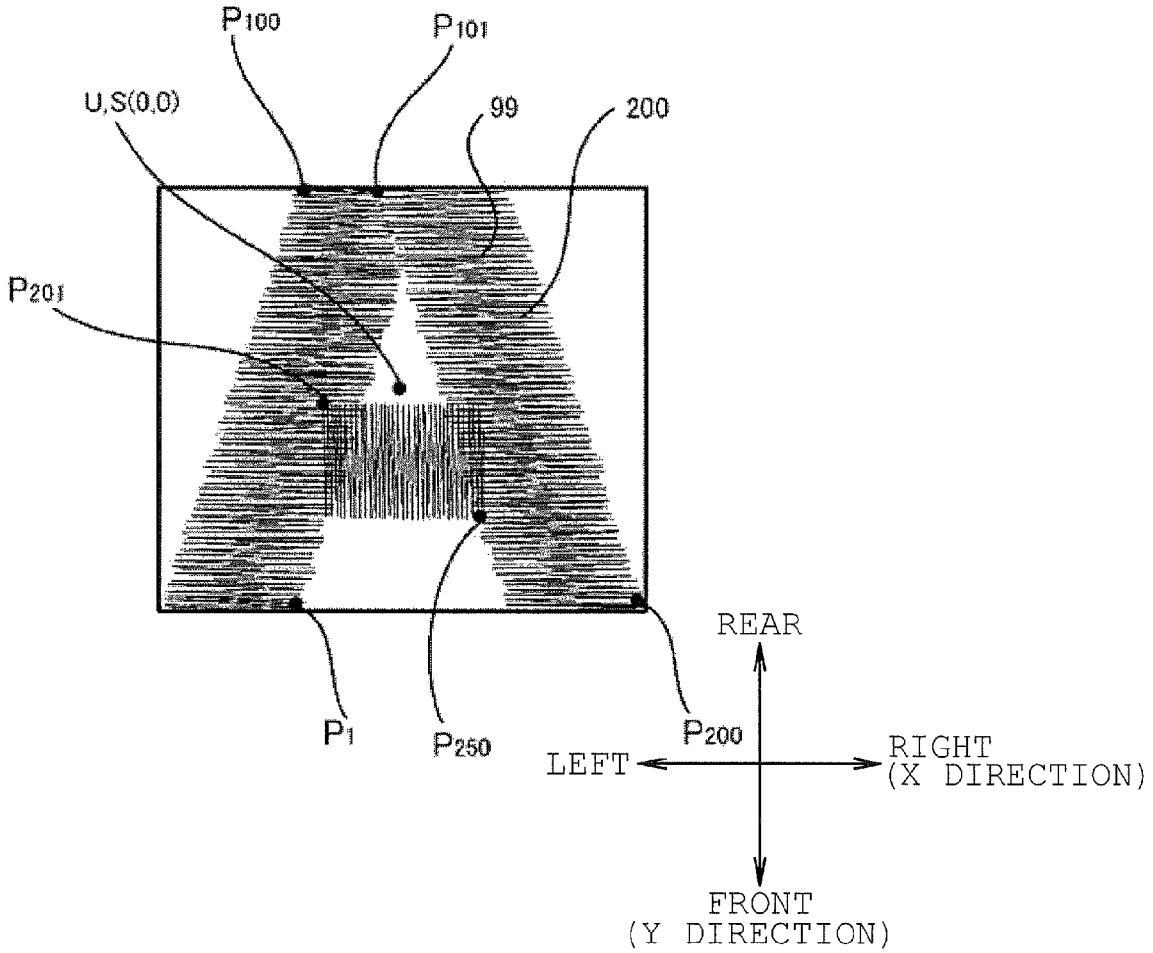
FIG. 7 is a view showing coordinates of sewing data $P_j$ in embroidery data.

Sewing data $P_1$ to $P_{250}$ of the embroidery data 200 as shown in FIG. 6 is used to sew an embroidery pattern of "A" as shown in FIG. 7. The embroidery pattern 99 of "A" is composed of three blocks, that is, a left inclined part "/," a right inclined part "\" and a lateral straight line part "−." Embroidery data $P_1$ to $P_{250}$ includes embroidery data $P_1$ to $P_{100}$ indicative of the left inclined part "/," embroidery data $P_{101}$ to $P_{200}$ indicative of the right inclined part and embroidery data $P_{201}$ to $P_{250}$ indicative of the lateral straight line part. These three blocks are sewn by satin stitches.

Embroidering Process

Figure 8:
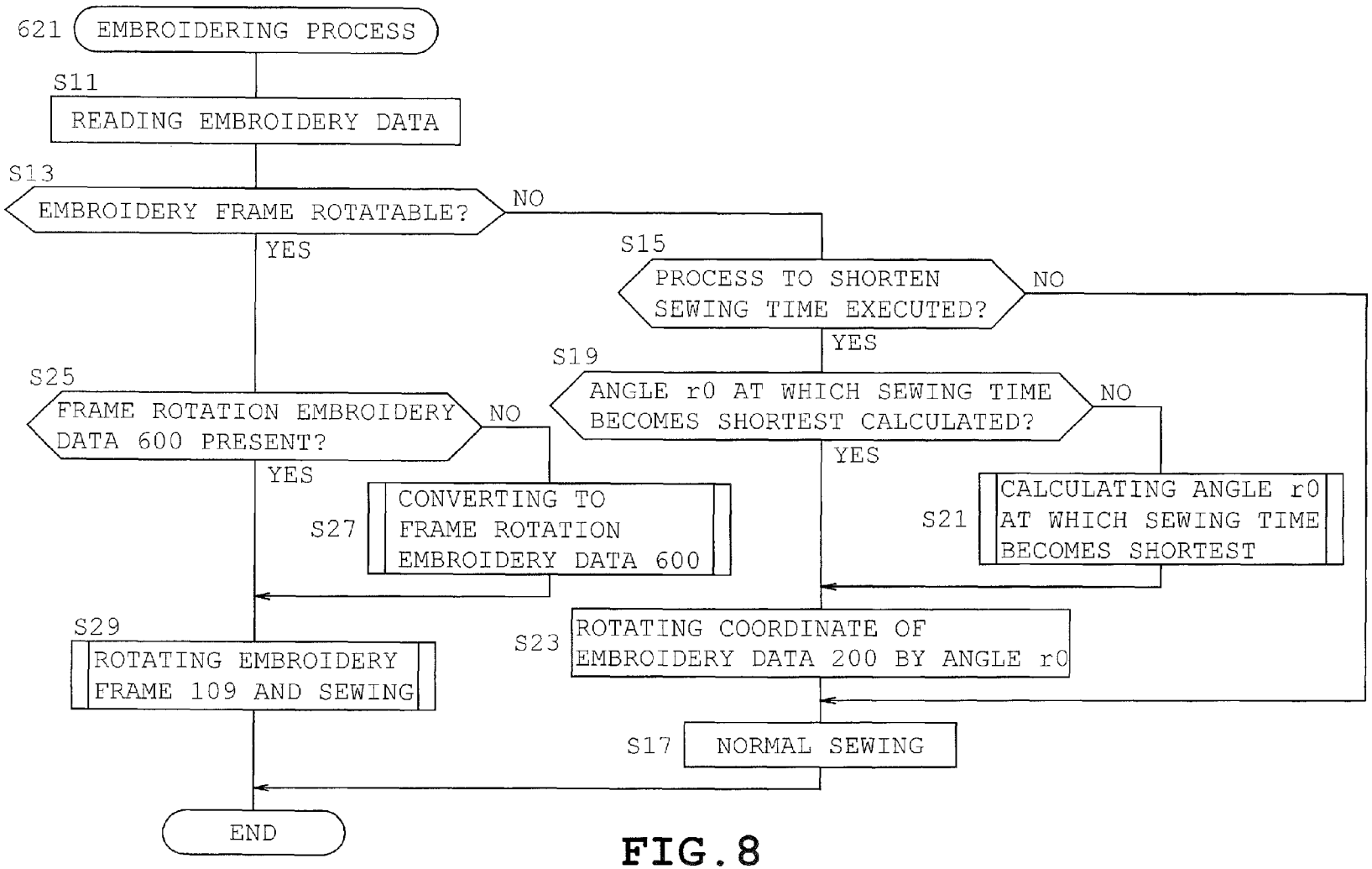
FIG. 8 is a flowchart showing an embroidery processing program.

An embroidering process will be described with reference to FIG. 8. The embroidering process is executed by a CPU 61 of the sewing machine 101. For example, when the user touches the touch panel 26 to select the embroidery pattern 99 as a pattern to be sewn, the CPU 61 reads out an embroidery processing program 621 from the ROM 62 to execute the embroidering process. Steps shown in the flowchart of FIG. 8 indicate processes executed by the CPU 61.

The CPU 61 proceeds to step S11 to read from the EEPROM 64 embroidery data 200 to sew the embroidery pattern 99 selected by the user. The CPU 61 then proceeds to step S13 to determine whether or not the embroidery frame is rotatable. More specifically, the CPU 61 determines whether or not the sewing machine side connector 352 of the attachment portion 351 of the sewing machine 101 is electrically connected to the frame side connector 944 of the embroidery frame 109. Since the embroidery frame 109B is provided with no frame side connector in this case, the sewing machine side connector 352 is open when the embroidery frame 109B is attached to the attachment portion 351. When determining that the connector 352 is connected to the connector 944, that is, when the embroidery frame 109 is attached to the attachment portion 351 (YES at step S13), the CPU 61 proceeds to step S25. When determining that the connector 352 is not connected to the connector 944, that is, when the embroidery frame 109B is connected to the attachment portion 351 (NO at step S13), the CPU 61 proceeds to step S15.

At step S15, the CPU 61 determines whether or not a process to shorten a sewing time is executed. More specifically, the CPU 61 displays on the display 15 a screen for the user to select whether or not the process to shorten the sewing time is executed. When the user touches the touch panel 26 and the CPU 61 detects selection of the process to shorten the sewing time (YES at step S15), the CPU 61 proceeds to step S19. When detecting selection of inexecution of the process to shorten the sewing time (NO at step S15), the CPU 61 proceeds to step S17.

At step S19, the CPU 61 determines whether or not an angle $r_0$ at which the sewing time becomes shortest has been selected. When the angle $r_0$ at which the sewing time becomes shortest has not been selected (NO at step S19), the CPU 61 proceeds to step S21. When the angle $r_0$ at which the sewing time becomes shortest has been selected (YES at step S19), the CPU 61 proceeds to step S23. In order to execute processes at steps S21 and S23, the CPU 61 reads an embroidery data processing program 622 from the ROM 62, executing embroidery data processing. In the embodiment, embroidery data processing includes steps S21 and S23.

At step S21, the CPU 61 executes a process of calculating an angle $r_0$ at which the sewing time becomes shortest. More specifically, the CPU 61 calculates a sewing time required to sew the embroidery pattern 99 by driving the x-axis and y-axis moving mechanisms, based on the embroidery data 200 stored in the EEPROM 64. The CPU 61 determines the angle $r_0$ at which the sewing time becomes shortest, based on the sewing time required to sew the embroidery pattern 99. The angle $r_0$ refers to a relative angle at which the embroidery pattern 99 is sewn relative to the x direction. The relative angle in step S21 refers to an angle by which x-y coordinate (the needle location point) of the sewing data $P_j$ of the embroidery pattern 99 is rotated.

At step S23, the CPU 61 rotates x-y coordinate of sewing data $P_j$ by the angle $r_0$, storing the obtained data in the EEPROM as coordinate rotation embroidery data 500. More specifically, x-y coordinate of sewing data $P_j$ is rotated about the center coordinate U (0, 0) of the mask data of the embroidery data 200, by the angle $r_0$ at which the sewing time becomes shortest. In other words, the CPU 61 converts sewing data $P_1$ (x1, y1) to $P_{250}$ (x250, y250) to sewing data $Q_1$ (x1', y1') to Q250 (x250, y250). Further more specifically, when x and y indicate an original coordinate value and x' and y' indicate a post-conversion coordinate value, sewing data $P_1$ (x1, y1) to $P_{250}$ (x250, y250) is converted by the following equations:

$$X'=x\cos(r_0)-y\sin(r_0) \quad (1)$$

$$Y'=x\sin(r_0)+y\cos(r_0) \quad (2)$$

Subsequently, the CPU 61 proceeds to step S17. The embroidery pattern 99 may be rotated with the left upper apex of the embroidery pattern 99 serving as the rotation center, instead of the center coordinate of the embroidery pattern 99.

The CPU 61 executes a normal sewing process at step S17. In the normal sewing process, sewing is executed while the x-axis and y-axis moving mechanisms are driven to move an embroidery frame without rotation of the embroidery frame. More specifically, the normal sewing refers to sewing by the use of the embroidery frame 109B. In other words, when determining at step S15 that the process of shortening the sewing time is executed, the CPU 61 executes the normal sewing based on needle location points of the coordinate rotation embroidery data 500 rotated at step S23. On the other hand, when determining at step S15 that the process of shortening the sewing time is not executed, the CPU 61 executes the normal sewing based on needle location points of the embroidery data 200 stored in the EEPROM 64. The CPU 61 generates and delivers a control signal to instruct the normal sewing process. In the normal sewing process, the x-axis motor 83 and the y-axis motor 84 are driven to sew the embroidery pattern 99 without rotation of the embroidery frame 109B. Accordingly, in order to execute the normal sewing process, the CPU 61 generates and delivers control signals to the drive circuits 72, 85 and 86 based on the coordinate rotation embroidery data 500 or the embroidery data 200. Subsequently, the CPU 61 ends the embroidery processing program 621.

On the other hand, when the rotatable embroidery frame 109 is attached to the attachment portion 351 (YES at step S13), the CPU 61 proceeds to step S25. At step S25, the CPU 61 determines whether or not frame rotation embroidery data 600 is stored in the EEPROM 64. When determining that the frame rotation embroidery data 600 is stored in the EEPROM 64 (YES at step S25), the CPU 61 proceeds to step S29. When determining that the frame rotation embroidery data 600 is not stored in the EEPROM 64 (NO at step S25), the CPU 61 proceeds to step S27.

In the process at step S27, the CPU 61 reads embroidery data processing program 622 from the ROM 62 to execute embroidery data processing. The CPU 61 executes a process of converting embroidery data 200 to frame rotation embroidery data 600 at step S27. In more detail, the CPU 61 calculates a value nSt based on the embroidery data 200 stored in the EEPROM 64. The value nSt contributes to a sewing time required to sew the embroidery pattern 99 by driving the x-axis and y-axis moving mechanisms. The CPU 61 then determines a relative angle at which the embroidery pattern 99 is sewn relative to the x direction, based on the calculated value nSt. The relative angle at step S27 refers to an angle by which a needle location point of sewing data $P_j$ of the embroidery pattern 99 and the embroidery frame 109 are rotated. Further, the CPU 61 stores the determined relative angle in the EEPROM 64 as frame rotation embroidery data 600 having a correspondence relation with the embroidery data 200 of the embroidery pattern 99. The value nSt contributing to the sewing time will be described later.

At step S29, the CPU 61 rotates the embroidery frame 109 to an angle at which the sewing time becomes shortest and sews the embroidery frame 109, based on the frame rotation embroidery data 600. When determining at step S13 that the embroidery frame 109 is rotatable, the CPU 61 rotates the embroidery frame 109 to the relative angle $\alpha$ determined at step S27. More specifically, the CPU 61 rotates the embroidery frame 109 to the angle $\alpha$ at which the sewing time becomes shortest to sew the embroidery pattern 99, based on the frame rotation embroidery data 600. The CPU 61 ends the embroidery processing program 621 after execution of step S29.

Calculation of Angle $r_0$ at which Sewing Time Becomes Shortest

Figure 9:
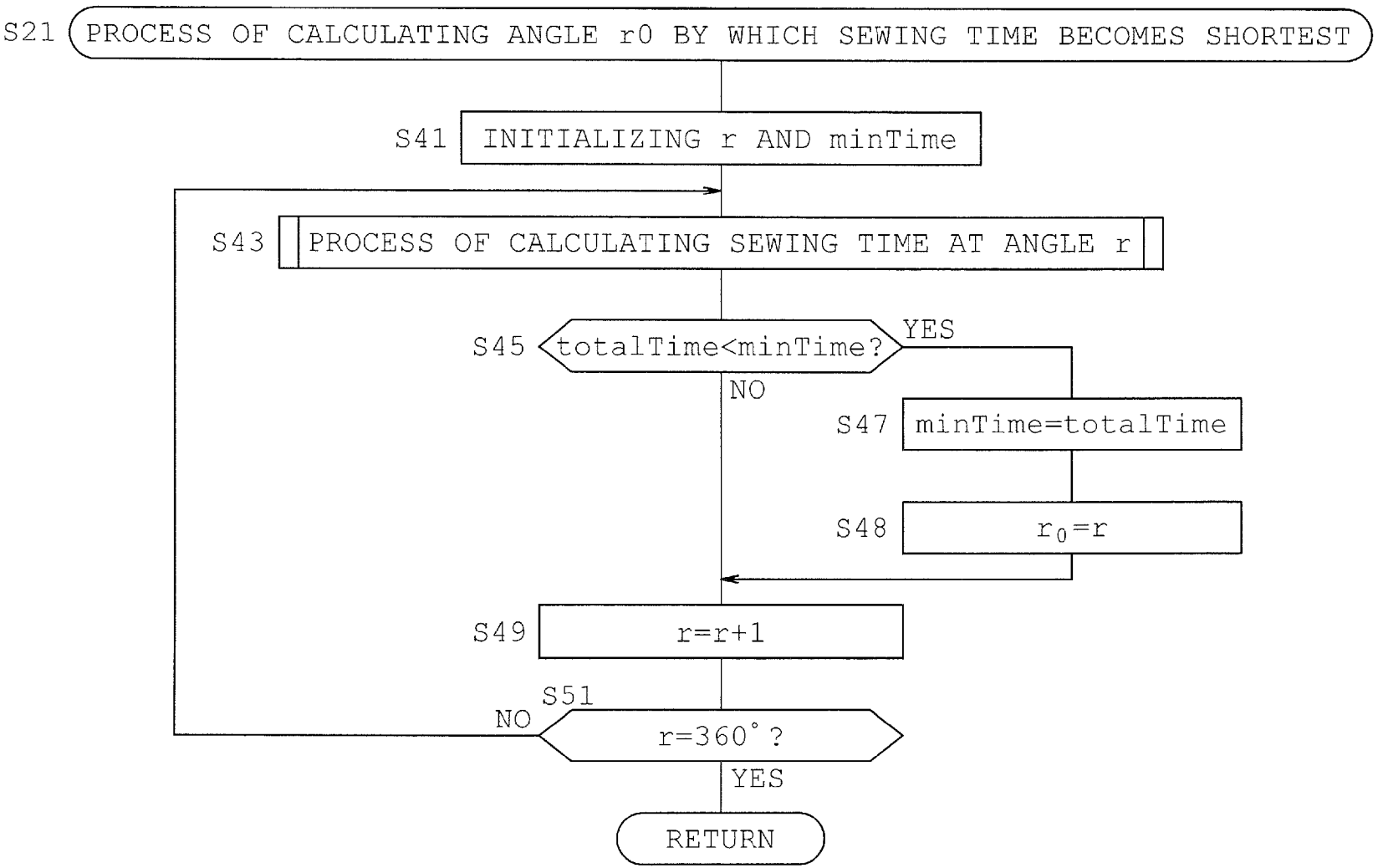
FIG. 9 is a flowchart showing a process of calculating an angle of the embroidery pattern, at which angle a sewing time becomes shortest.

Step S21 to calculate the angle $r_0$ of the embroidery pattern at which the sewing time becomes shortest will be described in detail with reference to FIG. 9. When starting the process at step S21, the CPU 61 proceeds to step S41 in FIG. 9.

At step S41, the CPU 61 initializes the angle r and the minimum time minTime. More specifically, the CPU 61 stores the initial value of 0° as the angle r in the RAM 63. The CPU 61 further stores in the RAM 63 a sewing time sufficiently larger than a normal sewing time, for example, 999 [sec] as the minimum time minTime. The minimum time minTime is used to calculate a shortest sewing time.

At step S43, the CPU 61 executes a process of calculating a sewing time in the case of angle r. More specifically, the CPU 61 calculates sewing times required to sew the embroidery pattern 99 in a plurality of different angles r in a range from 0° to 359°. Further more specifically, the CPU 61 calculates a sewing time totalTime in the angle r, storing the sewing time totalTime in the RAM 63.

At step S45, the CPU 61 compares, with the minimum time minTime, the sewing time totalTime required to sew the embroidery pattern 99 in the angle r calculated at step S43. More specifically, the CPU 61 determines whether or not the sewing time totalTime in the angle r is shorter than the minimum time minTime. When determining that the sewing time totalTime in the angle r is shorter than the minimum time minTime (YES at step S45), the CPU 61 proceeds to step S47. When determining that the sewing time totalTime in the angle r is longer than the minimum time minTime (NO at step S45), the CPU 61 proceeds to step S49. At step S47, the CPU 61 substitutes the sewing time totalTime for the minimum time minTime.

At step S48, the CPU 61 determines the angle $r_0$ at which the sewing time becomes shortest, based on the result of comparison of the sewing times in the angles r. More specifically, when determining that the sewing time totalTime is shorter than the minimum time minTime, the CPU 61 substitutes the angle r for the angle $r_0$ at which the sewing time becomes shortest. Subsequently, the CPU 61 proceeds to step S49. The CPU 61 adds 1° to the angle r at step S49.

At step S51, the CPU 61 determines whether or not the angle r is equal to 360°. When determining that the angle r is equal to 360° (YES at step S51), the CPU 61 ends the process of calculating the angle $r_0$ of the embroidery pattern by which the sewing time becomes shortest, proceeding to step S23 in FIG. 8. When determining that the angle r is not equal to 360° (NO at step S51), the CPU 61 returns to step S43. The CPU 61 thus calculates the angle $r_0$ of the embroidery pattern by which the sewing time becomes shortest, while changing the angle r every 1°.

Calculation of Sewing Time in Angle r

Figure 10:
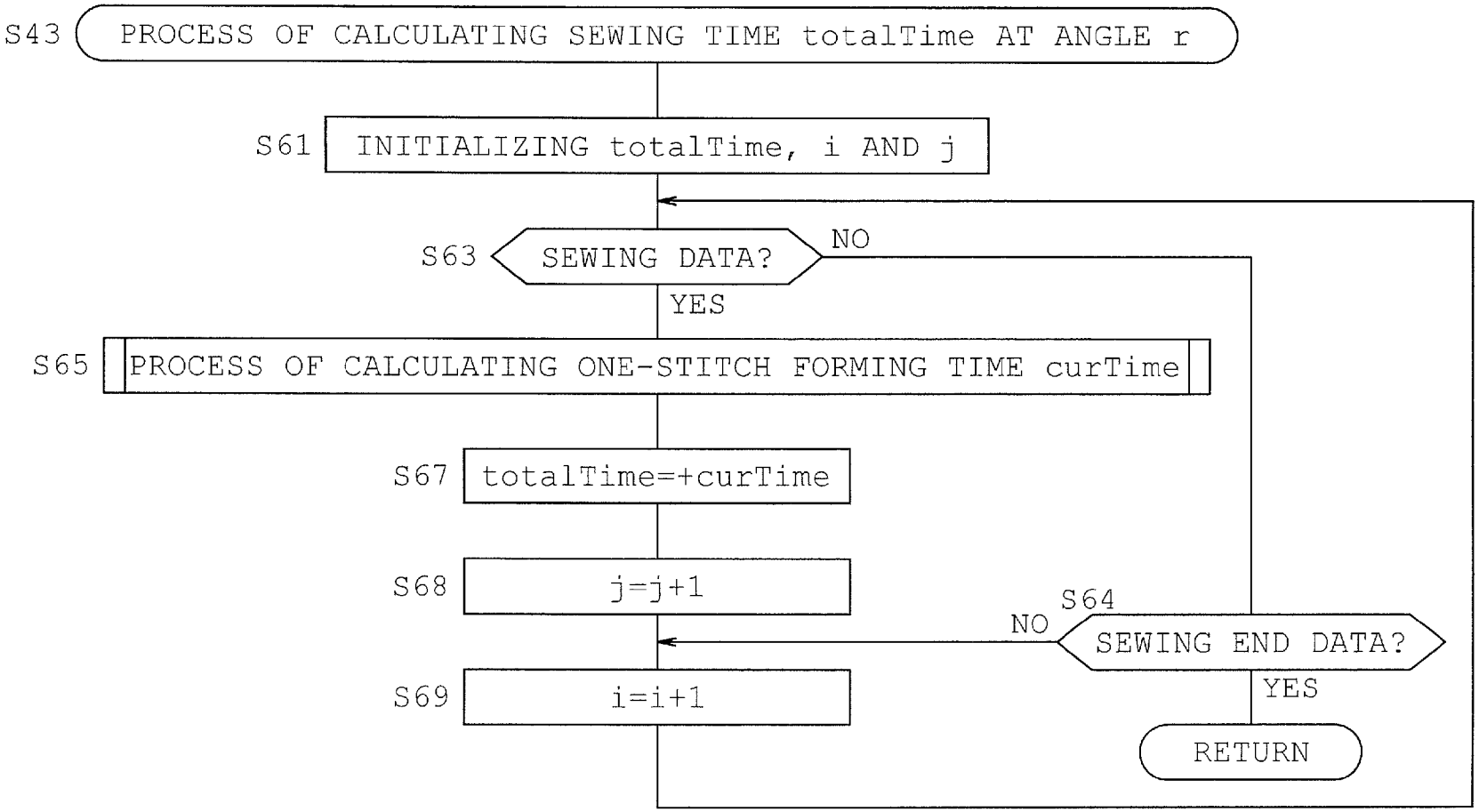
FIG. 10 is a flowchart showing a process of calculating a sewing time in the case of angle r.

A step S43 to calculate the sewing time totalTime in the angle r will be described in detail with reference to FIG. 10. When starting the process at step S43, the CPU 61 proceeds to step S61. At step S61, the CPU 61 initializes the sewing time totalTime in the angle r and variables i and j. More specifically, the CPU 61 substitutes 0 for the sewing time totalTime, 1 for variable i and 1 for variable j. Variable i indicates data number of the embroidery data 200. Variable j indicates data number of the sewing data $P_j$.

At step S63, the CPU 61 determines whether or not the i-th data is sewing data. When determining that the i-th data is sewing data (YES at step S63), the CPU 61 proceeds to step S65. When determining that the i-th data is not sewing data (NO at step S63), the CPU 61 proceeds to step S64. At step S64, the CPU 61 determines whether or not the i-th data is sewing end data. When determining that the i-th data is sewing end data (YES at step S64), the CPU 61 ends step S43 of calculating the sewing time in the angle r, returning to step S45 in FIG. 9. When determining that the i-th data is not sewing end data (NO at step S64), the CPU 61 proceeds to step S69.

At step S65, the CPU 61 calculates a one stitch forming time curTime required to form a first stitch by moving the embroidery frame 109B between two successive needle location points, based on a distance between the two needle location points which are successive in a sewing order, in a plurality of needle location points according to sewing data P1 to P250 in the angles r. The one stitch forming time curTime is the time curTime required to form a first stitch between two needle location points when the embroidery frame 109B is moved from a needle location point according to j-th sewing data $P_j$ to a needle location point according to j+1-th sewing data $P_{j+1}$.

At step S57, the CPU 61 adds up the one stitch forming times curTime calculated at step S65 thereby to calculate the sewing time totalTime required to sew the embroidery pattern 99. More specifically, the CPU 61 adds to the sewing time totalTime the first stitch forming time curTime required to form the first stitch between two needle location points when the embroidery frame 109B is moved from the needle location point according to j-th sewing data $P_j$ to the needle location point according to j+1-th sewing data $P_{j+1}$.

At step S68, the CPU 61 adds 1 to variable j in order to process all the sewing data of the embroidery data 200. The CPU 61 subsequently proceeds to step S69. At step S69, the CPU 61 adds 1 to variable i in order to process all the data of the embroidery data 200. The CPU 61 thereafter returns to step S63.

Calculation of One Stitch Forming Time curTime

Figure 11:
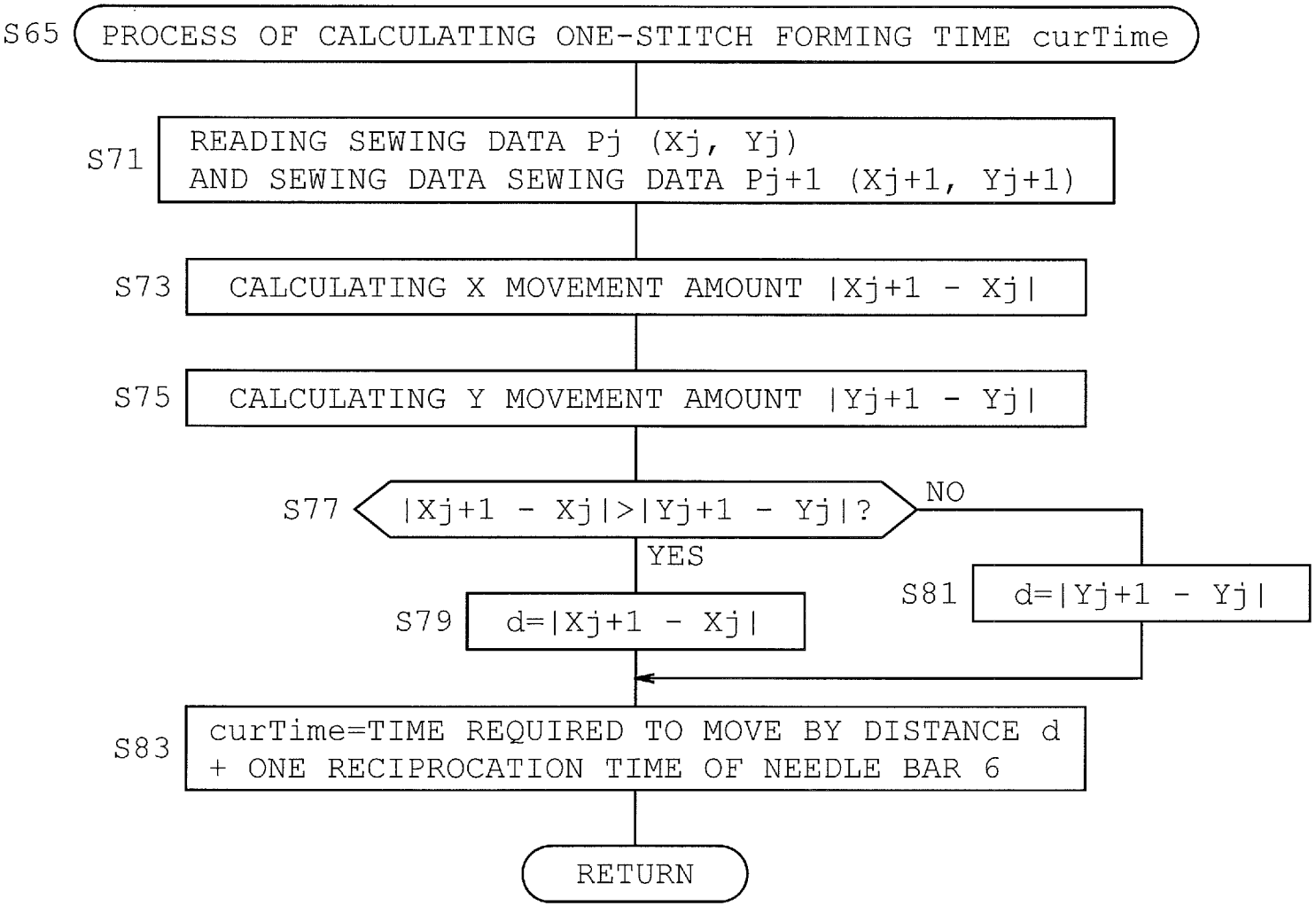
FIG. 11 is a flowchart showing a process of calculating a one stitch forming time.

Step S65 of calculating the one stitch forming time curTime will be described in detail with reference to FIG. 11. The one stitch forming time curTime is required to form one stitch by moving the embroidery frame 109B from the needle location point according to sewing data $P_j$ to the needle location point according to sewing data $P_{j+1}$. The CPU 61 proceeds to step S71 after having started processing at step S65. At step S71, the CPU 61 reads from the EEPROM 64 the j-th sewing data $P_j$ $(X_j, Y_j)$ and the j+1-th sewing data $P_{j+1}$ $(X_{j+1}, Y_{j+1})$.

At step S73, the CPU 61 calculates an amount of movement in the x direction, based on the distance from the needle location point according to the sewing data $P_j$ of the embroidery pattern 99 to the needle location point according to the sewing data $P_{j+1}$ and a direction from the needle location point according to the sewing data $P_j$ of the embroidery pattern 99 to the needle location point according to the sewing data $P_{j+1}$. The aforementioned amount of movement in the x direction refers to a case where the x-axis moving mechanism moves the embroidery frame 109B between the two needle location points according to the sewing data $P_j$ and $P_{j+1}$. Thus, the amount of movement in the x direction indicates an amount by which the embroidery frame 109B is moved from the needle location point of the j-th sewing data $P_j$ to the needle location point of the j+1-th sewing data $P_{j+1}$ in the x direction. More specifically, the amount of movement in the x direction is represented as $|X_{j+1}-X_j|$.

At step S75, the CPU 61 calculates an amount of movement in the y direction, based on the distance from the needle location point according to the sewing data $P_j$ of the embroidery pattern 99 to the needle location point according to the sewing data $P_{j+1}$ and a direction from the needle location point according to the sewing data $P_j$ of the embroidery pattern 99 to the needle location point according to the sewing data $P_{j+1}$. The aforementioned amount of movement in the y direction refers to a case where the y-axis moving mechanism moves the embroidery frame 109B between the two needle location points according to the sewing data $P_j$ and $P_{j+1}$. Thus, the amount of movement in the y direction indicates an amount by which the embroidery frame 109B is moved from the needle location point of the j-th sewing data $P_j$ to the needle location point of the j+1-th sewing data $P_{j+1}$ in the x direction. More specifically, the amount of movement in the x direction is represented as $|Y_{j+1}-Y_j|$.

At step S77, the CPU 61 determines whether or not the amount of x-direction movement calculated at step S73 regarding the section between two needle location points according to sewing data $P_j$ and $P_{j+1}$ is larger than the amount of y-direction movement calculated at step S75. More specifically, the CPU 61 determines whether or not $|X_{j+1}-X_j|$ is larger than $|Y_{j+1}-Y_j|$. When determining that $|X_{j+1}-X_j|$ is larger than $|Y_{j+1}-Y_j|$ (YES at step S77), the CPU 61 proceeds to step S79. When determining that $|X_{j+1}-X_j|$ is smaller than $|Y_{j+1}-Y_j|$ (NO at step S77), the CPU 61 proceeds to step S81.

When determining at step S77 that the amount of x-direction movement is larger than the amount of y-direction movement, the CPU 61 substitutes $|X_{j+1}-X_j|$ for distance d at step S79. Subsequently, the CPU 61 proceeds to step S83. When determining at step S77 that the amount of x-direction movement is smaller than the amount of y-direction movement, the CPU 61 substitutes $|Y_{j+1}-Y_j|$ for distance d at step S81. Subsequently, the CPU 61 proceeds to step S83.

At step S83, the CPU 61 adds a time required to reciprocate the needle bar 6 with the needle 7 in the up-down direction to a time required to move the embroidery frame 109B by distance d, thereby storing obtained addition in the RAM 63 as a one stitch forming time curTime. The time required to move the embroidery frame 109B is calculated from the following equation:

(Time required to move by distance(distance *d*)/(moving speed of *x*-axis or *y*-axis moving mechanism)

The CPU 61 subsequently ends the step S65 of calculating the one stitch forming time curTime, proceeding to step S67 in FIG. 10. In the embodiment, the x-axis and y-axis moving mechanisms can be driven simultaneously. The embroidery frame 109B is moved by the x-axis moving mechanism at the same moving speed as moved by the y-axis moving mechanism. Assume that the embroidery frame 109B is moved at the speed of 100 [mm/s]. Further assume that the time required to reciprocate the needle bar 6 with the needle 7 in the up-down direction has a constant value, for example, 0.1 [sec] for the sake of simplicity although depending upon a rotating speed of the sewing machine motor 79, that is, a sewing speed of the sewing machine 101.

For example, consider a case where the embroidery frame 109B is moved from coordinate V1 to coordinate V3. In this case, assume that a distance from coordinate V1 to coordinate V3 is distance d and that coordinate V1 is represented as (0, 0) and coordinate V3 is represented as (10, 20). Since the x-axis and y-axis moving mechanisms are simultaneously driven as described above, the embroidery frame 109B is firstly moved from coordinate V1 (0, 0) toward coordinate V2 (10, 10). Subsequently, the x-axis moving mechanism is stopped and only the y-axis moving mechanism is driven continuously. As a result, the embroidery frame 109B is moved from coordinate V2 (10, 10) to coordinate V3 (10, 20). Thus, only a longer one of the x-direction movement distance and the y-direction movement distance should be considered with respect to a moving time of the embroidery frame 109B. In this case, the time required to move the embroidery frame 109B by distance d is obtained as distance d=20 [mm]/speed 100 [mm/sec]=0.2 [sec]. Accordingly, the sewing time curTime is obtained as 0.2+0.1=0.3 [sec].

Conversion to Frame Rotation Embroidery Data 600

Figure 12:
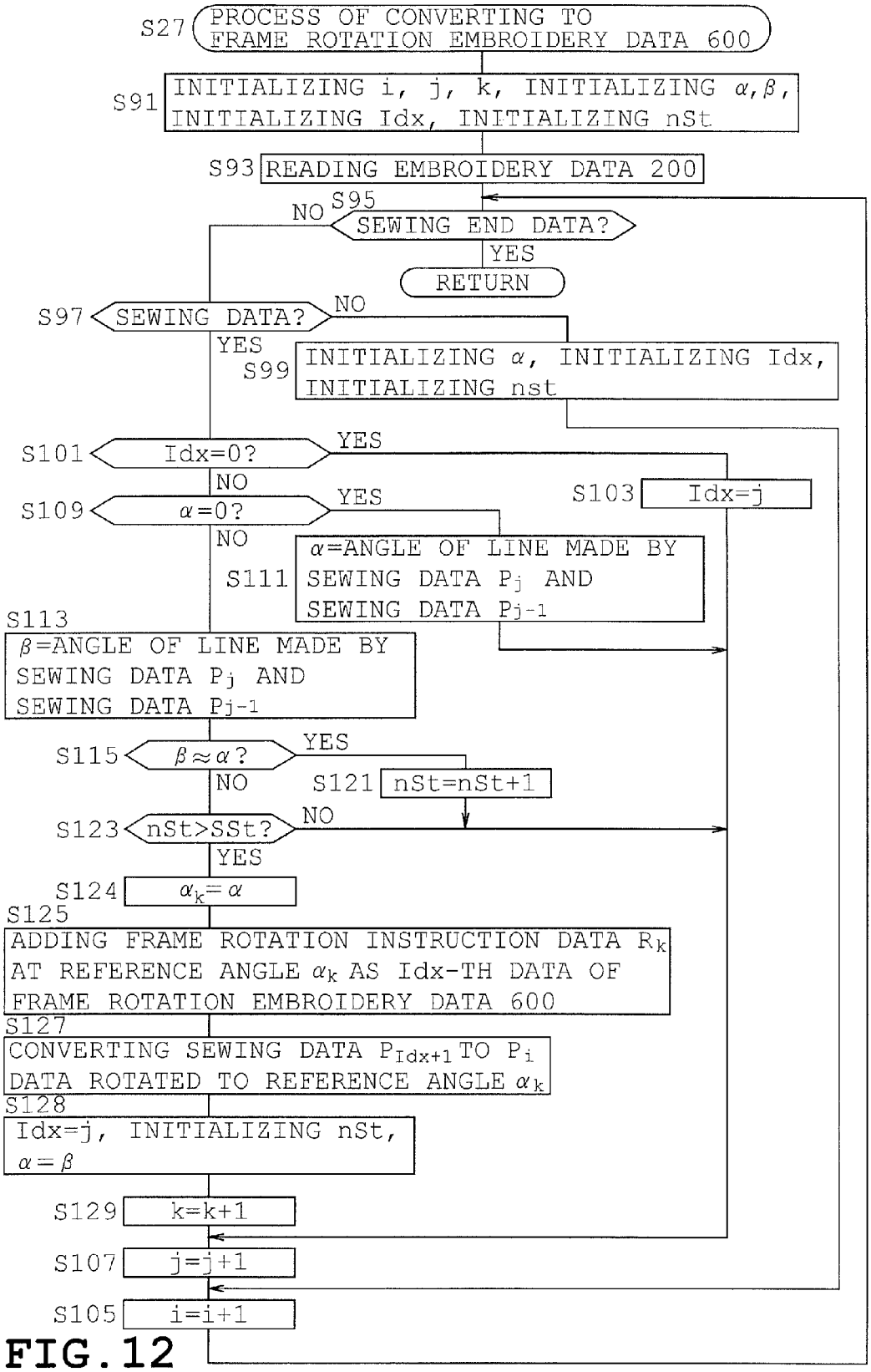
FIG. 12 is a flowchart showing a process of converting embroidery data to frame rotation embroidery data.

A process of converting to frame rotation embroidery data 600 (step S27) will be described in detail with reference to FIG. 12. The CPU 61 proceeds to step S91 in FIG. 12 after start of processing at S27. At step S91, the CPU 61 initializes variables i, j and k, reference angles α and β, a rotation start position Idx and consecutive numeral nSt. More specifically, the CPU 61 substitutes 1 for each one of variables i, j and k and consecutive numeral and substitutes 0 for each one of reference angles α and β and the rotation start position Idx. Variable i indicates data number of embroidery data 200. Variable j indicates data number of sewing data $P_j$. Variable k indicates the number of times at which the embroidery frame 109 is rotated. Reference angle α indicates an angle of a line made by the needle location point according to sewing data $P_j$ and the needle location point according to sewing data $P_{j-1}$. Reference angle β also indicates an angle of a line made by the needle location point according to sewing data $P_j$ and the needle location point according to sewing data $P_{j-1}$. Reference angle β is calculated as a target to be compared after calculation of reference angle α. The rotation start position Idx indicates data number that rotates the embroidery frame 109. The consecutive number nSt indicates the number of times at which the angle α made by a line connecting between two needle location points consecutive in sewing order and the x direction continuously takes the same angle.

At step S93, the CPU 61 reads embroidery data 200 from the EEPROM 64. At step S95, the CPU 61 determines whether or not i-th data is sewing end data. When determining that the i-th data is sewing end data (YES at step S95), the CPU 61 ends step S27, proceeding to step S29 in FIG. 8. When determining that the i-th data is not sewing end data (NO at step S95), the CPU 61 proceeds to step S97.

At step S97, the CPU 61 determines whether or not i-th data is sewing data. When determining that the i-th data is sewing data (YES at step S97), the CPU 61 proceeds to step S101. When determining that the i-th data is not sewing data (NO at step S97), the CPU 61 proceeds to step S99. At step S99, the CPU 61 initializes the reference angle α, the rotation start position Idx and the consecutive number nSt. More specifically, the CPU 61 substitutes 1 for the consecutive number nSt and 0 for each one of the reference angle α and the rotation start position Idx. The CPU 61 thereafter proceeds to step S105. At step S105, the CPU 61 adds 1 to variable i indicative of data number of embroidery data 200 in order to process all the data of embroidery data 200. The CPU 61 thereafter returns to step S95.

At step S101, the CPU 61 determines whether or not the rotation start position Idx is 0. When determining that the rotation start position Idx is 0 (YES at S101), the CPU 61 proceeds to step S103. When determining that the rotation start position Idx is not 0 (NO at step S101), the CPU 61 proceeds to step S109.

At step S103, the CPU 61 substitutes variable j for the rotation start position Idx. The CPU 61 thereafter proceeds to step S107. At step S107, the CPU 61 adds 1 to variable j indicative of data number of sewing data $P_j$ in order to process all the sewing data $P_j$ of embroidery data 200. The CPU 61 thereafter returns to step S105.

At step S109, the CPU 61 determines whether or not the reference angle α is 0. When determining that the reference angle α is 0 (YES at step S109), the CPU 61 proceeds to step S111. When determining that the reference angle α is not 0 (NO at step S109), the CPU 61 proceeds to step S113. At step S111, the CPU 61 calculates an angle made by a line connecting between two needle location points consecutive in sewing order of the sewing data of embroidery data 200 and the x direction continuously takes the same angle. More specifically, the CPU 61 substitutes for the reference angle α an angle made by the x direction and a line connecting between a needle location point according to j-th sewing data $P_j$ and a needle location point according to (j−1)-th sewing data $P_{j-1}$. The CPU 61 subsequently returns to step S107.

At step S113, the CPU 61 substitutes for the reference angle β an angle of a line connecting between the needle location point according to the j-th sewing data $P_j$ and the needle location point according to the (j−1)-th sewing data $P_{j-1}$.

At step S115, the CPU 61 determines whether or not the reference angle β is substantially equal to the reference angle α. When determining that the reference angle β is substantially equal to the reference angle α (YES at step S115), the CPU 61 proceeds to step S121. When determining that the reference angle β is not equal to the reference angle α (NO at step S115), the CPU 61 proceeds to step S123. Regarding "substantially equal to," the determination step S115 has a margin of error of plus or minus 5°.

At step S121, the CPU 61 calculates a value contributing to a sewing time based on the angle α made by the line connecting between two contiguous needle location points obtained at step S111 and the x direction. More specifically, the CPU 61 calculates, as the value contributing to the sewing time, a consecutive number of times nSt at which the above-mentioned angle α continuously takes the same value. The CPU 61 adds 1 to the consecutive number of times nSt in order to calculate the consecutive number of times. The CPU 61 subsequently returns to step S107.

At step S123, the CPU 61 determines whether or not the calculated consecutive number of times nSt is larger than a reference value SSt. When determining that the consecutive number of times nSt is larger than the reference value SSt (YES at step S123), the CPU 61 proceeds to step S124. When determining that the calculated consecutive number of times nSt is smaller than the reference value SSt (NO at step S123), the CPU 61 returns to step S107. The reference value SSt is set so that the sewing time of the embroidery pattern 99 can be shortened even when an angle by which the embroidery frame 109 is rotated is large. For example, the reference value SSt is set to 20. However, the reference value SSt may be set to an appropriate value.

At step S124, the CPU 61 determines the angle α consecutively taking the same value as a relative angle $\alpha_k$. More specifically, the CPU 61 substitutes the angle $\alpha_k$ for the angle α. At step S125, the CPU 61 adds frame rotation instruction data $R_k$ as rotation start position Idx data in the embroidery data 200. The frame rotation instruction data $R_k$ includes a frame rotation instruction code and the angle $\alpha_k$. The CPU 61 stores as frame rotation embroidery data 600 data including the embroidery data 200 and the frame rotation instruction data $R_k$ in the EEPROM 64. More specifically, the CPU 61 stores frame rotation instruction data $R_1$ in the first data as the frame rotation embroidery data 600.

At S127, the CPU 61 converts (Idx+1)-th to j-th sewing data $P_{Idx+1}$ to $P_j$ to data obtained by rotating the embroidery pattern to the reference angle α. More specifically, when Idx+1=2 and j=101, the CPU 61 converts sewing data $P_1$ to $P_{100}$ of the embroidery data 200 to sewing data $T_1$ to $T_{100}$ obtained by rotating the embroidery pattern to angle $\alpha_1$ about the rotation center S of the embroidery frame 109. The CPU 61 repeats the same processing to convert sewing data $P_{101}$ to $P_{250}$ of the embroidery data 200 to frame rotation instruction data $R_2$ of the frame rotation embroidery data 600, sewing data $T_{101}$ to $T_{200}$, frame rotation instruction data $R_3$ and sewing data $T_{201}$ to $T_{250}$.

At step S128, the CPU 61 substitutes j for the rotation start position Idx and initializes the consecutive number of times nSt. The CPU 61 further substitutes the reference angle β for the reference angle α. The CPU 61 subsequently proceeds to step S129. At step S129, the CPU 61 adds 1 to a variable k indicative of the number of rotations in order to count the number of rotations of the embroidery frame 109 during the sewing of the embroidery pattern 99. Subsequently, the CPU 61 returns to step S107.

Process of Sewing with Embroidery Frame 109 being Rotated

Figure 13:
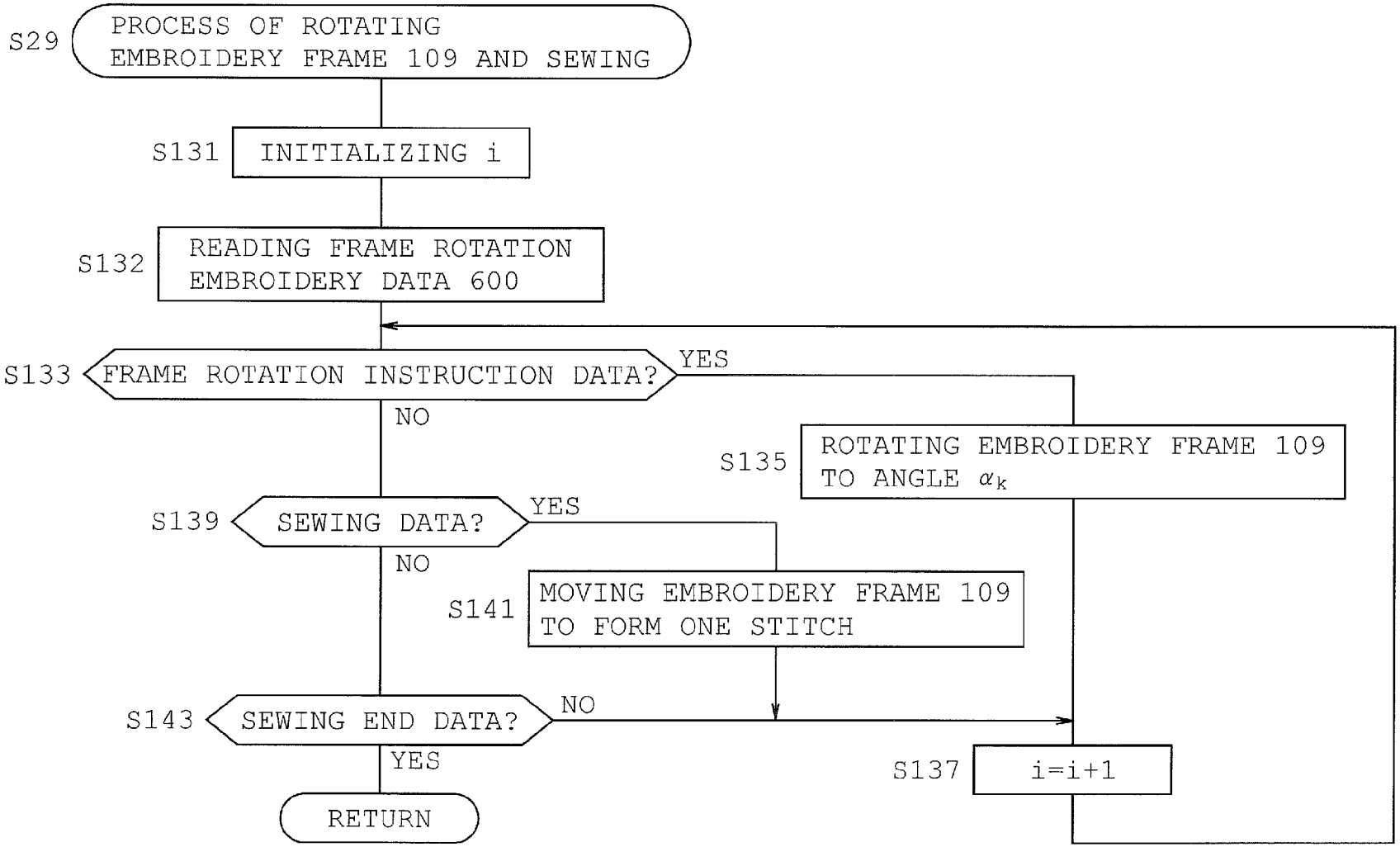
FIG. 13 is a flowchart showing a process of sewing with the embroidery frame being rotated.

Step S29 of sewing with the embroidery frame 109 being rotated will be described in detail with reference to FIG. 13. The CPU 61 proceeds to step S131 in FIG. 13 after the process at step S29 has started. At step S131, the CPU 61 initializes the variable i. More specifically, the CPU 61 substitutes 1 for the variable i. At step S132, the CPU 61 reads the frame rotation embroidery data 600 from the EEPROM 64. At step S133, the CPU 61 determines whether or not i-th data of the frame rotation embroidery data 600 is frame rotation instruction data. When determining that the i-th data of the frame rotation embroidery data 600 is frame rotation instruction data (YES at step S133), the CPU 61 proceeds to step S135. When determining that the i-th data of the frame rotation embroidery data 600 is not frame rotation instruction data (NO at step S133), the CPU 61 proceeds to step S139.

At step S135, the CPU 61 rotates the embroidery frame 109 to the relative angle determined at step S27. More specifically, the CPU 61 rotates the embroidery frame 109 to the reference angle $\alpha_k$ stored in the frame rotation instruction data $R_k$. In more detail, the CPU 61 reads the frame rotation instruction data $R_k$ corresponding to the i-th data of the frame rotation embroidery data 600. The CPU 61 then rotates an electric motor 947 of the outer frame 94 by the difference between the reference angle $\alpha_k$ of the read frame rotation instruction data $R_k$ and the current angle. At step S137, the CPU 61 adds 1 to the variable i indicative of data number of embroidery data 600 in order to process all the data of the frame rotation embroidery data 600. The CPU 61 subsequently returns to step S133.

At step S139, the CPU 61 determines whether or not the i-th data of the frame rotation embroidery data 600 is sewing data. When determining that the i-th data of the frame rotation embroidery data 600 is sewing data (YES at step S139), the CPU 61 proceeds to step S141. When determining that the i-th data of the frame rotation embroidery data 600 is not sewing data (NO at step S139), the CPU 61 proceeds to step S143. At step S141, the CPU 61 drives the x-axis and y-axis moving mechanisms to move the embroidery frame 109 and execute sewing based on sewing data $T_j$ of the embroidery data 600, after having rotated the embroidery frame 109 at step S135. More specifically, the CPU 61 supplies control signals to the drive circuits 85 and 86. The control signal moves the embroidery frame 109 to the needle location point of the j-th sewing data $P_j$. Upon receipt of the control signals from the CPU 61, the drive circuits 85 and 86 rotate the x-axis and y-axis motors 83 and 84 by an amount to move from the needle location point of the (j−1)-th sewing data $P_{j-1}$ to the needle location point of the j-th sewing data $P_1$. The CPU 61 further supplies a control signal to form a first stitch to the drive circuit 72. Upon receipt of the control signal from the CPU 61, the drive circuit 72 rotates the sewing machine motor 79 by an amount sufficient to reciprocate the needle bar 6. The CPU 61 subsequently returns to step S137.

At step S143, the CPU 61 determines whether or not the i-th data is sewing end data. When determining that the i-th data is sewing end data (YES at step S143), the CPU 61 rotates the embroidery frame 109 and ends the step S29 of the sewing process thereby to end the embroidering process shown in FIG. 8. When the i-th data is not sewing end data (NO at step S143), the CPU 61 returns to step S137.

Sewing Procedure of Embroidery Pattern 99

Figure 14:
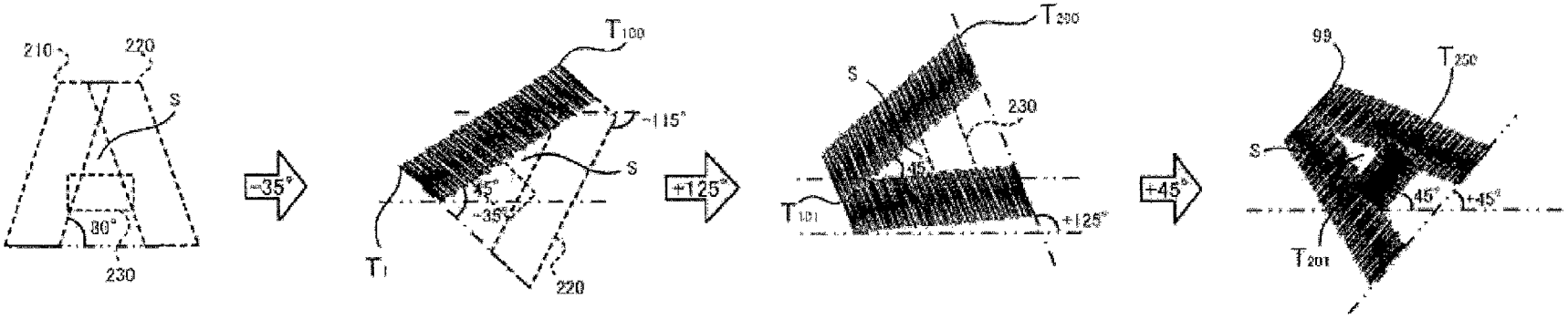
FIG. 14 is a view showing a procedure of sewing the embroidery pattern.

The process of rotating the embroidery frame 109 and sewing the embroidery pattern 99 of "A" (step S29) will be described more concretely with reference to FIG. 14. The CPU 61 initializes the variable i and reads the frame rotation embroidery data 600 from the EEPROM 64. As described above, the embroidery pattern 99 of "A" is composed of three blocks, that is, a left inclined part "/," a right inclined part "\" and a lateral straight line part "−." The embroidery pattern 99 is sewn by satin stitches. The left inclined part "/" will be referred to as a first block 210. The right inclined part "\" will be referred to as a second block 220. The lateral straight line part "−" will be referred to as a third block 230.

The first block 210 composed of the sewing data $T_1$ to $T_{100}$ extends in the direction of +80°. When the embroidery frame 109 is moved by a predetermined distance, the angle at which the embroidery frame 109 can be moved in a shortest time is +45° at which the x-axis and y-axis moving mechanisms are driven simultaneously. Accordingly, since the current angle is 0°, the reference angle α1 of frame rotation instruction data $R_1$ which is the first data (i=1) is obtained as 45°−80°=−35°.

When i=1, the first data (i=1) of the frame rotation embroidery data 600 is the frame rotation instruction data $R_1$ at step S133. Accordingly, the CPU 61 proceeds to step S135. Since the reference angle α1 of the frame rotation instruction data R1 is −35°, the CPU 61 rotates the embroidery frame 109 about the center S thereof by −35°. At step S137, the CPU 61 adds 1 to variable i with the result of variable i=2. When i=2, the second data of the frame rotation embroidery data 600 is not frame rotation instruction data (NO at step S133) but sewing data (YES at S139). Accordingly, the CPU 61 proceeds to step S141. At step S141, the CPU 61 simultaneously drives the x-axis and y-axis moving mechanisms to move the embroidery frame 109 to the angle of 45° relative to the X direction, thereby executing sewing based on sewing data $T_1$. At step S137, the CPU 61 adds 1 to variable i=2 with the result of variable i=3. The CPU 61 subsequently repeats steps S133, S139, S141 and S137 from sewing data $T_2$ to $T_{100}$, thereby sewing the first block 210.

The second block 220 composed of the sewing data $T_{101}$ to $T_{200}$ extends in the direction of −115°. When the embroidery frame 109 is moved by a predetermined distance, the angle at which the embroidery frame 109 can be moved in a shortest time is +45° at which the x-axis and y-axis moving mechanisms are driven simultaneously. Accordingly, since the current angle is −35°, the reference angle α2 of frame rotation instruction data $R_2$ which is the one-hundred-and-second data (i=102) is obtained as) −35°±{45°−(−115°)}=+125°.

When i=102, the one-hundred-and-second data of the frame rotation embroidery data 600 is frame rotation instruction data $R_2$. Accordingly, the CPU 61 proceeds to step S135. Since the reference angle α2 of the frame rotation instruction data $R_2$ is +125° at step S135, the CPU 61 rotates the embroidery frame 109 to +125° about the center S thereof. When i=103 to 202, the CPU 61 proceeds to step S141 to simultaneously drive the x-axis and y-axis moving mechanisms to move the embroidery frame 109 to the angle of 45°, thereby sewing the second block 220.

The third block 230 composed of the sewing data $T_{201}$ to $T_{250}$ extends in the direction of +125°. When the embroidery frame 109 is moved by a predetermined distance, the angle at which the embroidery frame 109 can be moved in a shortest time is +45° at which the x-axis and y-axis moving mechanisms are driven simultaneously. Accordingly, since the current angle is +125°, the reference angle α3 of frame rotation instruction data $R_3$ which is the two-hundred-and-third data (i=203) is obtained as +125°+{45°−125°)}=+45°.

When i=203, the two-hundred-and-third data of the frame rotation embroidery data 600 is frame rotation instruction data $R_3$. Accordingly, the CPU 61 proceeds to step S135. Since the reference angle α3 of the frame rotation instruction data $R_3$ is +45° at step S135, the CPU 61 rotates the embroidery frame 109 to +45° about the center S thereof. When i=204 to 253, the CPU 61 proceeds to step S133 to simultaneously drive the x-axis and y-axis moving mechanisms to move the embroidery frame 109 to the angle of 45°, thereby sewing the third block 230. The embroidery pattern 99 is thus sewn.

Firstly, the following advantageous effects can be achieved from the case where the embroidery frame 109B is attached to the sewing machine 101. At step S21, the CPU 61 calculates sewing times in cases where the embroidery pattern is located at respective angles r (r ranges from 0° to 359°). The CPU 61 compares the obtained sewing times thereby to be capable of determining an angle of the embroidery pattern at which sewing can be executed in a shortest time. Consequently, the sewing machine 101 can sew the embroidery pattern in the shortest sewing time by sewing the embroidery pattern at the determined angle.

The x-axis and y-axis moving mechanisms can be simultaneously driven. Further, the moving speed at which the embroidery frame 109B is moved by the y-axis moving mechanism is equal to the moving speed at which the embroidery frame 109B is moved by the x-axis moving mechanism. Accordingly, the CPU 61 calculates either longer one of distances d in the X and Y directions which are moving directions of the embroidery frame 109B between needle location points, whereby the CPU 61 can calculate one stitch forming time curTime.

Next, the following advantageous effects can be achieved from the case where the embroidery frame 109 is attached to the sewing machine 101. When an angle by which the embroidery frame 109 is rotated is large and the consecutive number nSt of needle location points sewn at the +45° position to which the embroidery frame 109 can be moved in a shortest time is small, there is sometimes a case where the sewing times become shorter without rotation of the embroidery frame 109. Accordingly, the CPU 61 determines at step S123 whether or not the consecutive number nSt is larger than the reference number SSt. As a result, the CPU 61 rotates the embroidery frame 109 only when the sewing time can be shortened by rotation of the embroidery frame 109.

As understood from the foregoing, there are two manners of shortening a sewing time required to sew the embroidery pattern 99. In a first manner, the embroidery frame is rotated, and in a second manner, the embroidery data of embroidery pattern 99 is rotated. The angle can be changed during the sewing when the embroidery frame 109 is rotated. This can further shorten the sewing time as compared with the second manner in which the embroidery data of embroidery pattern 99 is rotated. Accordingly, when determining at step S13 that the embroidery frame is rotatable, the sewing machine 101 executes the manner in which the embroidery frame 109 is rotated. Consequently, the sewing machine 101 can sew the embroidery pattern 99 in a further shorter time.

The foregoing embodiment should not be restrictive but may be modified or expanded. At step S123, the CPU 61 determines whether or not the continuous number nSt serving as the value contributing to the sewing time is larger than the reference number SSt, thereby determining the angle $\alpha_k$ by which the embroidery pattern 109 is rotated. However, the value contributing to the sewing time may be a distance and a direction between needle location points.

Further, the CPU 61 may determine the angle $\alpha_k$ in consideration of the time required to rotate the embroidery frame 109. In order to calculate this required time, the CPU 61 may calculate a time required to rotate the embroidery frame 109 to an angle $\alpha_k$ position from the current angle of the embroidery frame 109. The CPU 61 then calculates a time required to sew a needle location point of j-th sewing data from Idx the number of which is represented by the consecutive number nSt, after rotation of the embroidery frame 109 by the angle $\alpha_k$. The CPU 61 then calculates a time by adding the time required to rotate the embroidery frame 109 by angle $\alpha_k$ and the time required to sew the needle location point of j-th sewing data from Idx, as the time in the case where the embroidery frame 109 is rotated. Further, the CPU 61 calculates a time required to sew the needle location point of j-th sewing data from Idx without rotation of the embroidery frame 109. The CPU 61 thus compares the time required in the case where the embroidery frame 109 is rotated with the time required in the case where the embroidery frame 109 is not rotated, thereby determining whether or not the embroidery frame 109 should be rotated.

When determining at step S13 that the embroidery frame is rotatable, the CPU 61 executes the process of rotating the embroidery frame and sewing the embroidery frame 109. Alternatively, the CPU 61 may execute a process of rotating the embroidery pattern 99 and sewing the embroidery pattern 99.

Although the lockstitch sewing machine 101 is employed in the foregoing embodiment, a multi-needle sewing machine may be employed, instead.

The CPU 61 executes the embroidery processing program 621 stored in the ROM 62, whereby various functions are put into practice in the sewing machine 101. The CPU 61 can be specified as a control section which controls various functions of the sewing machine 101. The embroidery processing program is written onto the ROM 62 at the time of factory shipment of the sewing machine 101. The ROM 62 is an example of computer-readable storage devices. An HDD, a RAM or the like may be used instead of the ROM 62. Further, in this case, the storage device may be non-transitory. Still further, the embroidery processing program 621 may be stored in a storage medium of an external server or the like. When stored in a server, the embroidery processing program 621 is downloaded via a connection interface from an external server or the like thereby to be stored in the ROM 62. Although the sewing machine 101 functions as a device processing embroidery data in the foregoing embodiment, a personal computer may be functioned as the device processing embroidery data. Further, although the embroidery data processing program 622 causes the sewing machine 101 to execute processing of the embroidery data in the foregoing embodiment, a personal computer separate from the sewing machine 101 may be caused to execute the processing of embroidery data.

The foregoing embodiment includes means for calculating the sewing time of the embroidery pattern 99, means for determining the angle of the embroidery pattern 99 and means for storing the angle at which the sewing time becomes shortest. These means are realized by the software executed by the CPU 61. Alternatively, the means may be each realized by hardware.

The embroidery data processing device, the sewing machine and the non-transitory computer-readable medium, all described above with reference to the various embodiments are merely examples. It goes without saying that they are not confined to the depicted embodiments. While various features have been described in conjunction with the examples outlined above, various advantages, modifications, variations, and/or improvements of those features and/or examples may be possible. Accordingly, the examples, as set forth above, are intended to be illustrative. Various changes may be made without departing from the broad spirit and scope of the underlying principles.

I claim:

1. An embroidery data device comprising:

a processor; and a memory configured to store embroidery data moving an embroidery frame and computer-readable instructions that, when executed by the processor, cause the processor to perform processes including:

calculating a sewing time in which a first moving mechanism and a second moving mechanism are driven to move the embroidery frame in a first direction and a second direction perpendicular to the first direction thereby to sew the embroidery pattern or a value contributing to the sewing time, based on the embroidery data;

determining an angle relative to the first or second direction, at which angle the embroidery pattern is sewn, based on the calculated sewing time or the value contributing to the sewing time;

storing, in the memory, the determined relative angle having a correspondence relation with the embroidery data of the embroidery pattern;

calculating sewing times required to sew the embroidery pattern at a plurality of different angles;

comparing one of the calculated amounts of sewing time with each other; and determining a relative angle at which an amount of sewing time becomes shortest, based on a result of the comparison.

2. The processor according to claim 1, wherein the processes further comprise:

calculating a one-stitch forming time required to form a stitch between two successive needle location points, based on a distance between the successive needle location points included in a plurality of needle location points contained in the embroidery data at the respective angles, the two needle location points being successive in a sewing order;

adding the calculated one-stitch forming times together thereby to calculate a sewing time required to sew the embroidery pattern.

3. The processor according to claim 2, wherein the processes further comprise:

calculating a first amount of movement by which the first moving mechanism moves the embroidery frame in the first direction between two needle location points, based on a distance and a direction between the two needle location points which are successive in a sewing order;

calculating a second amount of movement by which the second moving mechanism moves the embroidery frame in the second direction between two needle location points, based on a distance and a direction between the two needle location points which are successive in a sewing order;

determining whether or not the first amount of movement is larger than the second amount of movement;

adding a time required to reciprocate a needle bar once to a movement time required to move by the first amount of movement thereby to calculate a one-stitch forming time, when it is determined that the first amount of movement is larger than the second amount of movement; and adding a time required to reciprocate a needle bar once to a movement time required to move by the second amount of movement thereby to calculate a one-stitch forming time, when it is determined that the first amount of movement is smaller than the second amount of movement.

4. An embroidery data device comprising:

a processor; and a memory configured to store embroidery data moving an embroidery frame and computer-readable instructions that, when executed by the processor, cause the processor to perform processes including:

calculating a sewing time in which a first moving mechanism and a second moving mechanism are driven to move the embroidery frame in a first direction and a second direction perpendicular to the first direction thereby to sew the embroidery pattern or a value contributing to the sewing time, based on the embroidery data;

determining an angle relative to the first or second direction, at which angle the embroidery pattern is sewn, based on the calculated sewing time or the value contributing to the sewing time;

storing, in the memory, the determined relative angle having a correspondence relation with the embroidery data of the embroidery pattern;

calculating an angle made by a line connecting between two needle location points that are consecutive in a sewing order and are contained in the embroidery data, relative to the first direction; and calculating a value contributing to a sewing time, based on the calculated angle.

5. The processor according to claim 4, wherein the processes further comprise:

calculating as a value contributing to a sewing time a successive number of needle location points where an angle made between a line connecting between two needle location points which are successive in a sewing order and the first direction becomes equal;

determining whether or not the calculated successive number is larger than a predetermined reference number; and determining the successively equal angle as a relative angle between the embroidery pattern and the first direction when it is determined that the successive number is larger than the reference value.

6. A sewing machine comprising:

a sewing unit driving a first moving mechanism moving an embroidery frame in a first direction and a second moving mechanism moving the embroidery frame in a second direction perpendicular to the first direction, the second moving mechanism being drivable simultaneously with the first moving mechanism;

a processor; and a memory configured to store embroidery data moving an embroidery frame and computer-readable instructions that, when executed by the processor, cause the processor to perform processes comprising:

calculating a sewing time in which a first moving mechanism and a second moving mechanism are driven to move the embroidery frame in a first direction and a second direction perpendicular to the first direction thereby to sew the embroidery pattern or a value contributing to the sewing time, based on the embroidery data;

determining an angle relative to the first or second direction, at which angle the embroidery pattern is sewn, based on the calculated sewing time or the value contributing to the sewing time;

driving the first moving mechanism and the second moving mechanism to sew the embroidery pattern, based on the determined relative angle;

determining whether or not the embroidery frame is rotatable;

rotating the embroidery frame to the determined relative angle when the processor determines that the embroidery frame is rotatable; and driving the first moving mechanism and the second moving mechanism so that the embroidery frame is moved after rotation thereof and is sewn according to the embroidery data.

7. The sewing machine according to claim 6, wherein the processes further comprise:

rotating needle location points of the embroidery data to the determined relative angles when the processor determines that the embroidery frame is not rotatable; and driving the first moving mechanism and the second moving mechanism so that the embroidery frame is moved according to the needle location points of the rotated embroidery data, whereby the embroidery pattern is sewn.

8. A non-transitory computer-readable medium storing a program for an apparatus including:

a sewing unit driving a first moving mechanism moving an embroidery frame in a first direction and a second moving mechanism moving the embroidery frame in a second direction perpendicular to the first direction;

a processor; and a memory configured to store embroidery data, wherein the program causing the processor to execute instructions comprising:

calculating a sewing time in which a first moving mechanism and a second moving mechanism are driven to move the embroidery frame in a first direction and a second direction perpendicular to the first direction thereby to sew the embroidery pattern or a value contributing to the sewing time, based on the embroidery data;

determining an angle relative to the first or second direction, at which angle the embroidery pattern is sewn, based on the calculated sewing time or the value contributing to the sewing time;

storing, in the memory, the determined relative angle having a correspondence relation with the embroidery data of the embroidery pattern;

calculating sewing times required to sew the embroidery pattern at a plurality of different angles;

comparing one of the calculated amounts of sewing time with each other; and determining a relative angle at which an amount of sewing time becomes shortest, based on a result of the comparison.

* * * * *